US011585594B2

(12) United States Patent
Lee et al.

(10) Patent No.: US 11,585,594 B2
(45) Date of Patent: Feb. 21, 2023

(54) REFRIGERATOR

(71) Applicant: LG ELECTRONICS INC., Seoul (KR)

(72) Inventors: Sunghun Lee, Seoul (KR); Jinho Chang, Seoul (KR); Seungyoon Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/285,285

(22) PCT Filed: Oct. 17, 2019

(86) PCT No.: PCT/KR2019/013633
§ 371 (c)(1),
(2) Date: Apr. 14, 2021

(87) PCT Pub. No.: WO2020/080840
PCT Pub. Date: Apr. 23, 2020

(65) Prior Publication Data

US 2021/0389046 A1 Dec. 16, 2021

(30) Foreign Application Priority Data

Oct. 19, 2018 (KR) ..... 10-2018-0125315

(51) Int. Cl.
*F25D 25/02* (2006.01)
*F25D 23/02* (2006.01)
(Continued)

(52) U.S. Cl.
CPC ..... *F25D 25/025* (2013.01); *A47B 88/457* (2017.01); *A47B 88/90* (2017.01);
(Continued)

(58) Field of Classification Search
CPC ... F25D 25/025; F25D 25/028; A47B 88/457; A47B 2088/901; A47B 2210/175
See application file for complete search history.

(56) References Cited

U.S. PATENT DOCUMENTS 7,165,415 B2 1/2007 Nam et al.
7,581,796 B2 9/2009 Jeong et al.
(Continued)

FOREIGN PATENT DOCUMENTS

CN 202057149 U 2/2006
CN 202057149 U 12/2007
(Continued)

OTHER PUBLICATIONS

Search Report of the European Patent Office from Appl'n No. 19872664.8 dated Jun. 2022.
(Continued)

*Primary Examiner* — Kimberley S Wright
(74) *Attorney, Agent, or Firm* — Dentons US LLP

(57) ABSTRACT

A refrigerator includes: a cabinet having a storage space; a door including a door unit to open or close the storage space and a drawer unit to provide a receiving space; a driving device disposed at the door unit and configured to provide power; and an elevation device disposed at the drawer unit, connected with the driving device, and configured to move up or down, in which the driving device includes: a motor assembly including a driving motor, a screw rotated by power from the driving motor and extending in an up-down direction, and a movable unit to move up and down along the screw; and a pair of lever units connected to the movable unit at both sides of the motor assembly, and each of the pair of lever units includes: a first lever connected to the movable unit; and a second lever connected with the first lever and connected with the elevation device.

22 Claims, 17 Drawing Sheets

(51) Int. Cl.
*A47B 88/457* (2017.01)
*A47B 88/90* (2017.01)

(52) U.S. Cl.
CPC ..... *F25D 23/021* (2013.01); *F25D 23/028* (2013.01); *A47B 2088/901* (2017.01); *A47B 2210/175* (2013.01)

(56) References Cited

U.S. PATENT DOCUMENTS

| | | | | |
|---|---|---|---|---|
| 9,377,238 | B2 | 6/2016 | Hall et al. | |
| 10,465,970 | B1 * | 11/2019 | Kang | F25D 25/025 |
| 10,598,426 | B2 * | 3/2020 | Kang | F25D 25/025 |
| 10,900,709 | B2 * | 1/2021 | Kang | F25D 25/025 |
| 10,945,524 | B2 * | 3/2021 | Choi | A47B 88/44 |
| 11,248,837 | B2 * | 2/2022 | Choi | F25D 11/02 |
| 2005/0150245 | A1 | 7/2005 | Nam et al. | |
| 2008/0203041 | A1 * | 8/2008 | Lim | F25D 25/02 211/119.003 |
| 2014/0265797 | A1 | 9/2014 | Scheuring et al. | |
| 2014/0265806 | A1 | 9/2014 | Hall et al. | |
| 2019/0323763 | A1 * | 10/2019 | Kang | F25D 25/025 |
| 2020/0069055 | A1 * | 3/2020 | Choi | A47B 88/457 |
| 2020/0072539 | A1 * | 3/2020 | Park | F25D 23/021 |

FOREIGN PATENT DOCUMENTS

| | | | |
|---|---|---|---|
| KR | 10-2008-0079101 | A | 8/2008 |
| KR | 10-2016-0019643 | A | 2/2016 |
| WO | 2014159370 | A1 | 10/2014 |

OTHER PUBLICATIONS

Office Action of Chinese Patent Office in Appl'n. No. 201980068469.X, dated Jun. 1, 2022.

* cited by examiner

[Fig. 1]
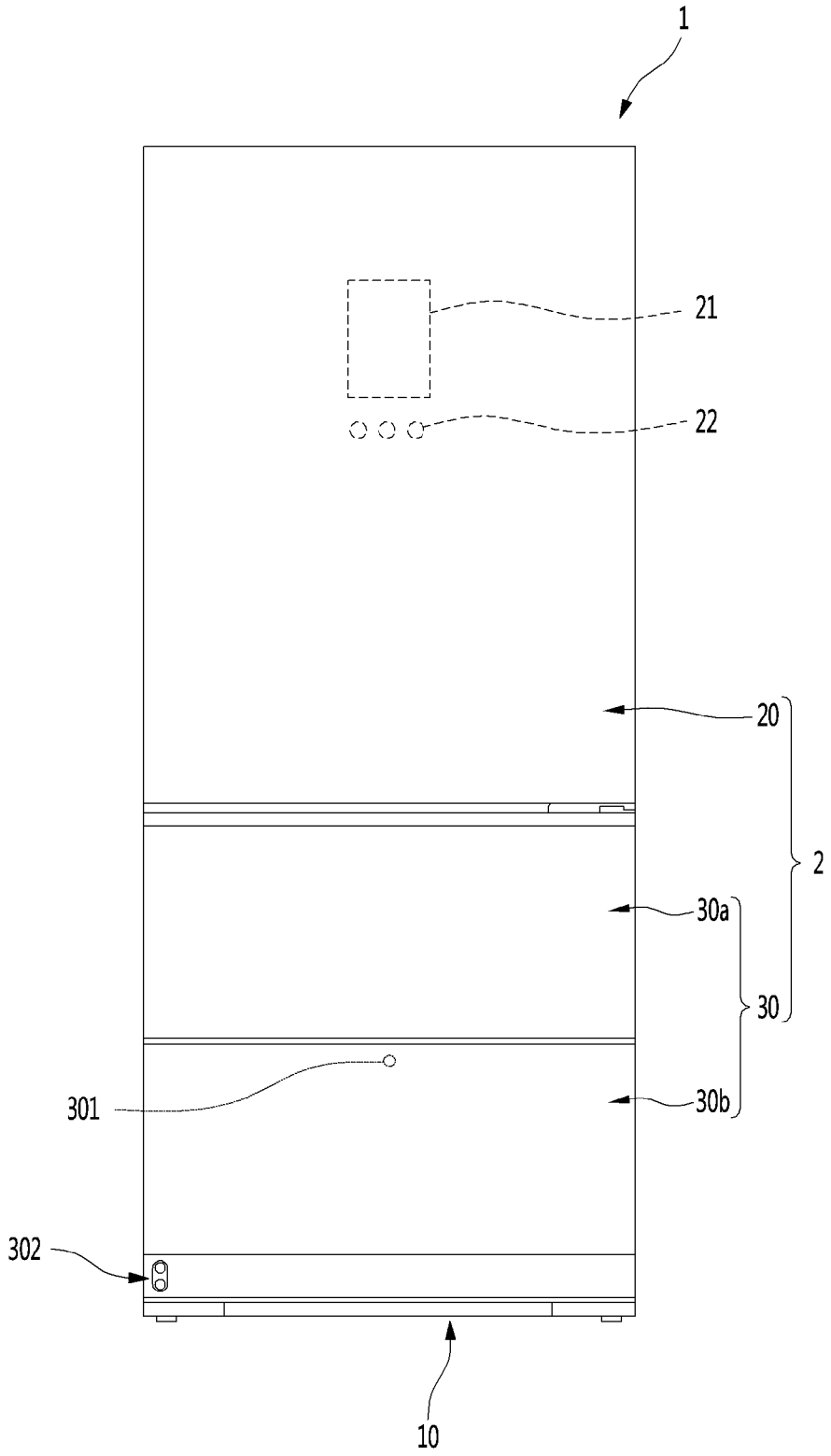

[Fig. 2]
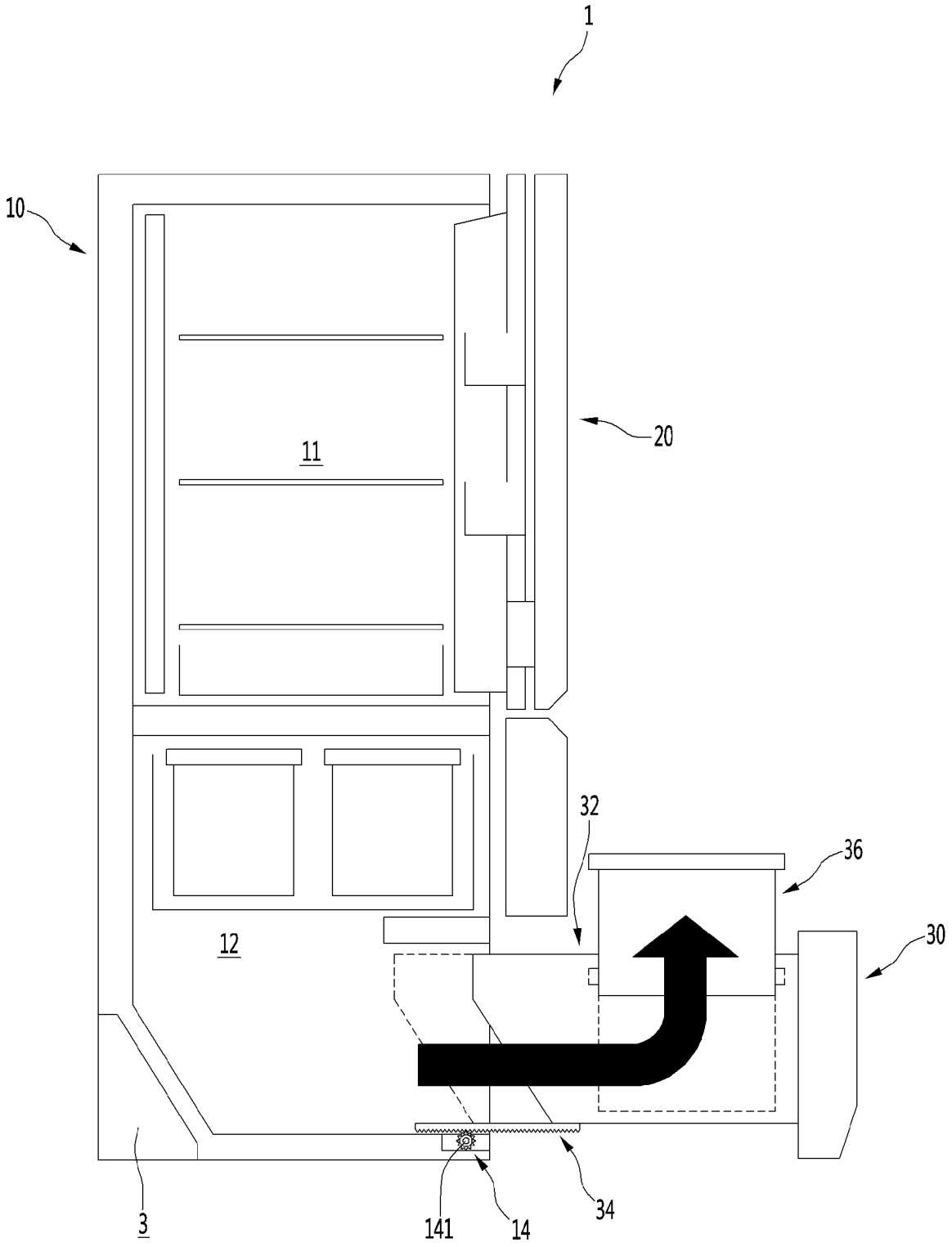

[Fig. 3]
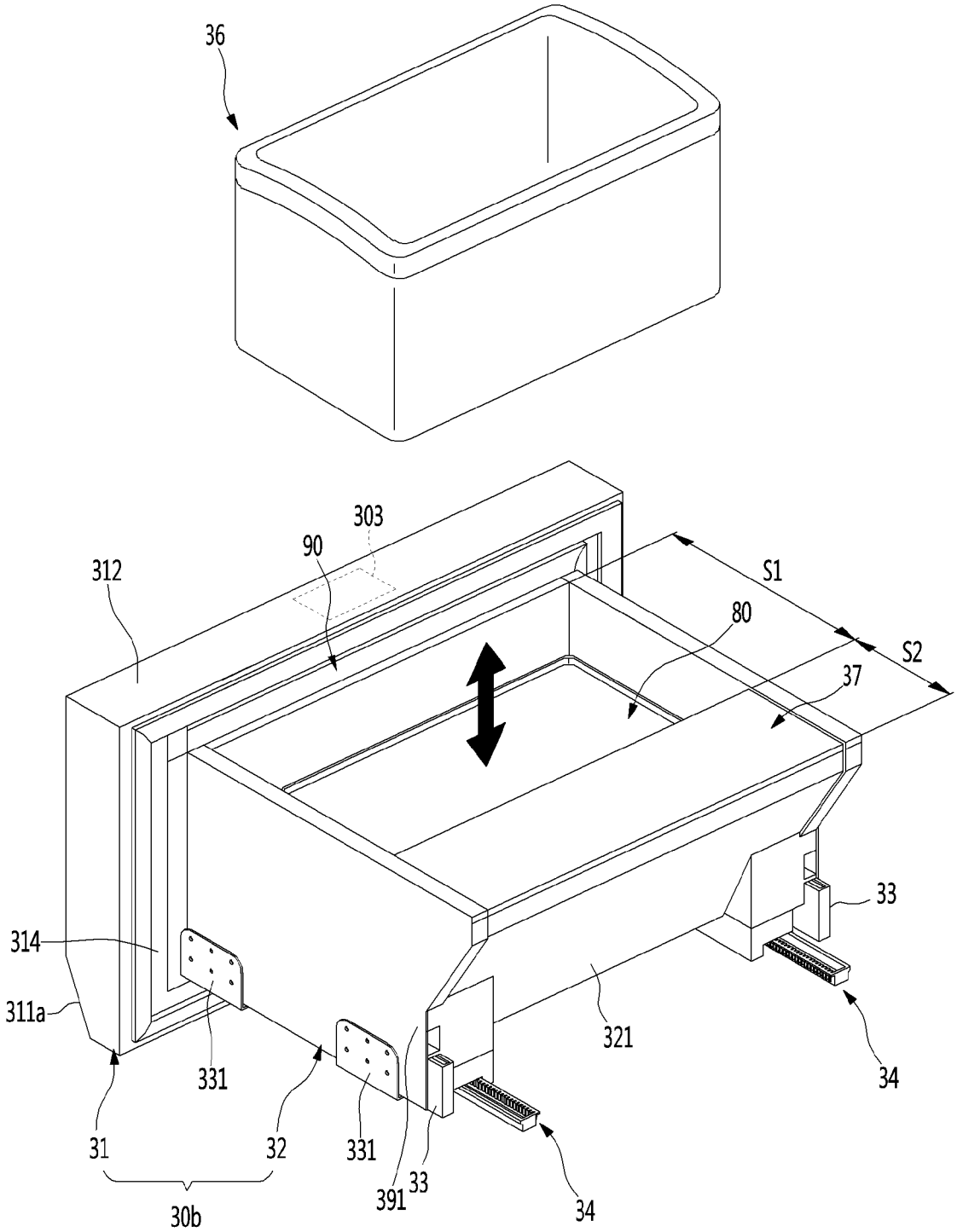

[Fig. 4]
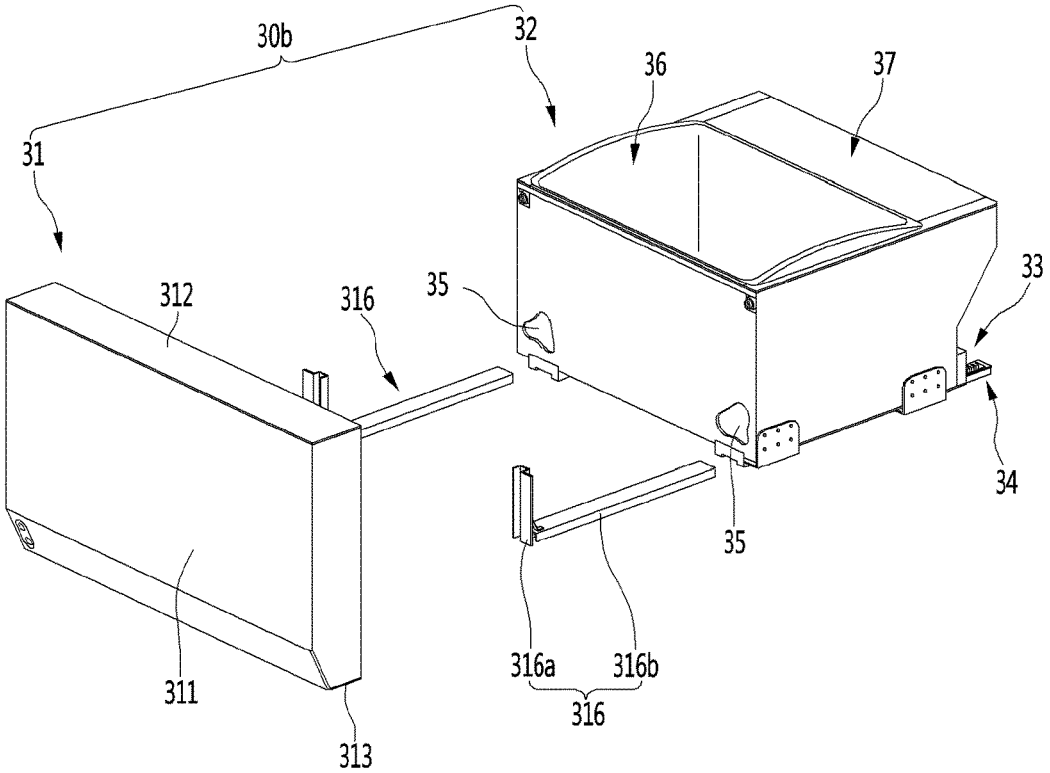
[Fig. 5]
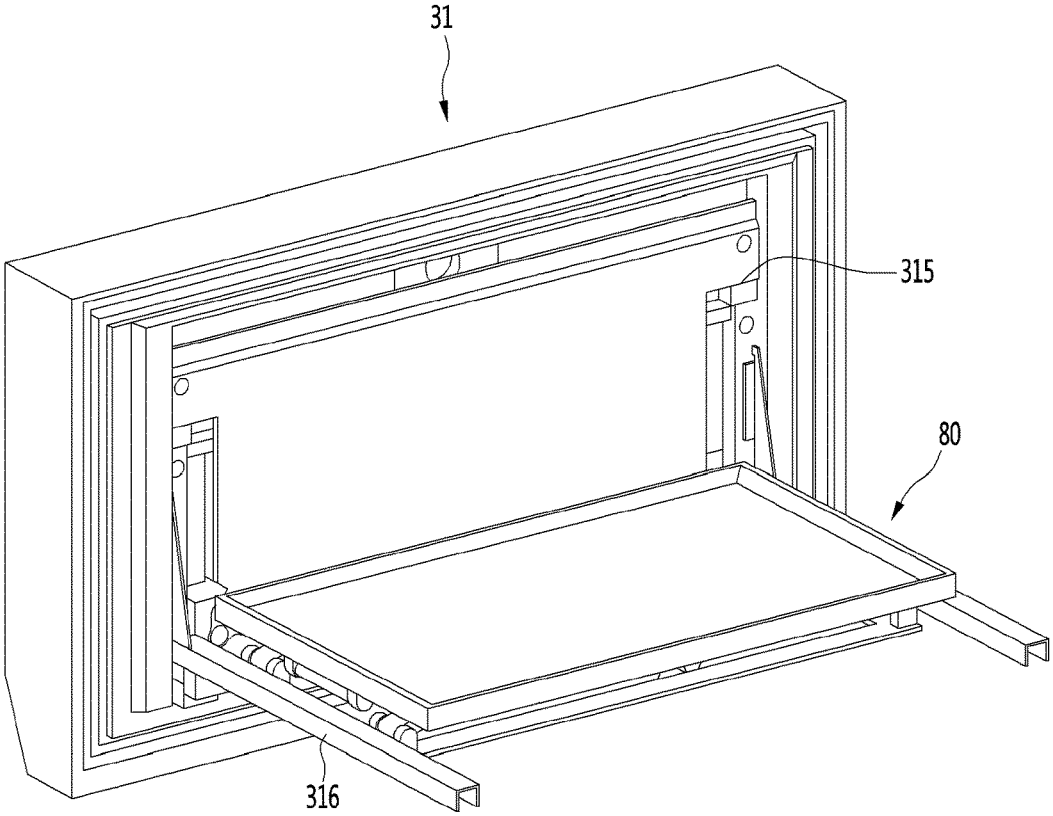

[Fig. 6]
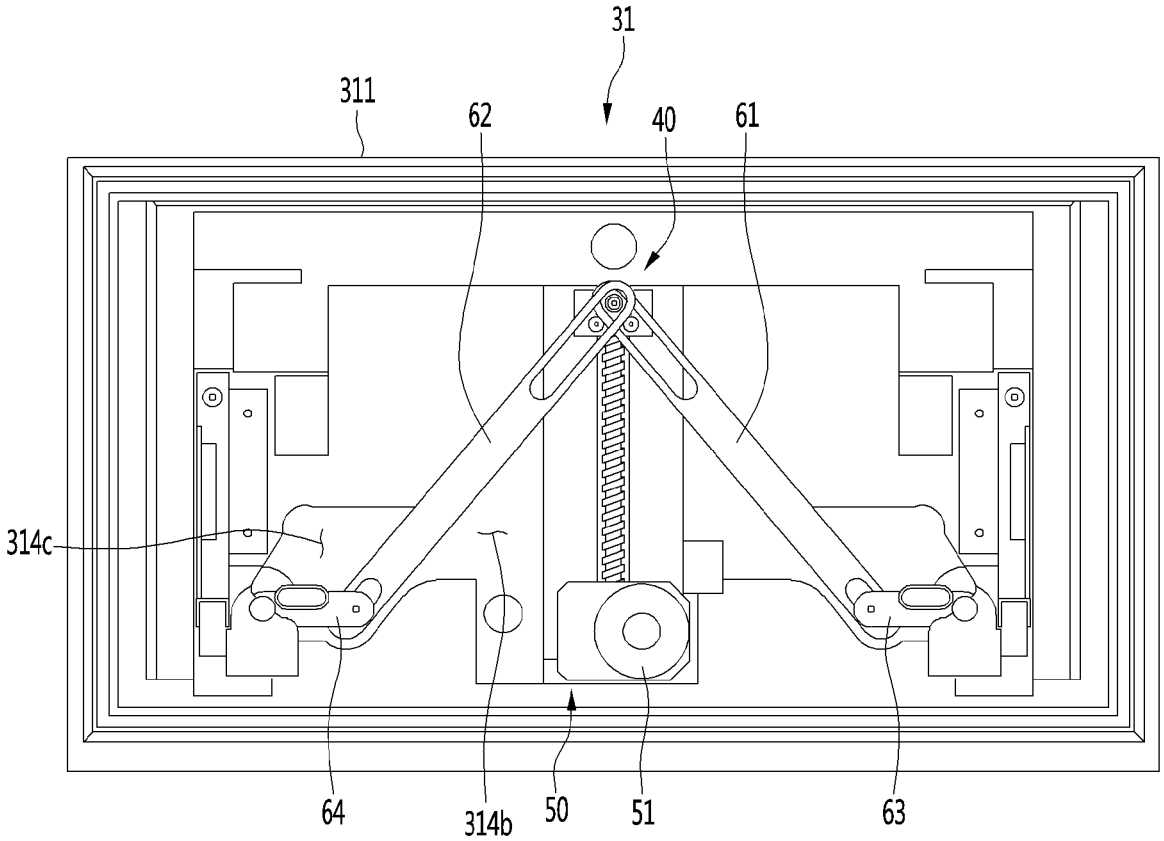

[Fig. 7]
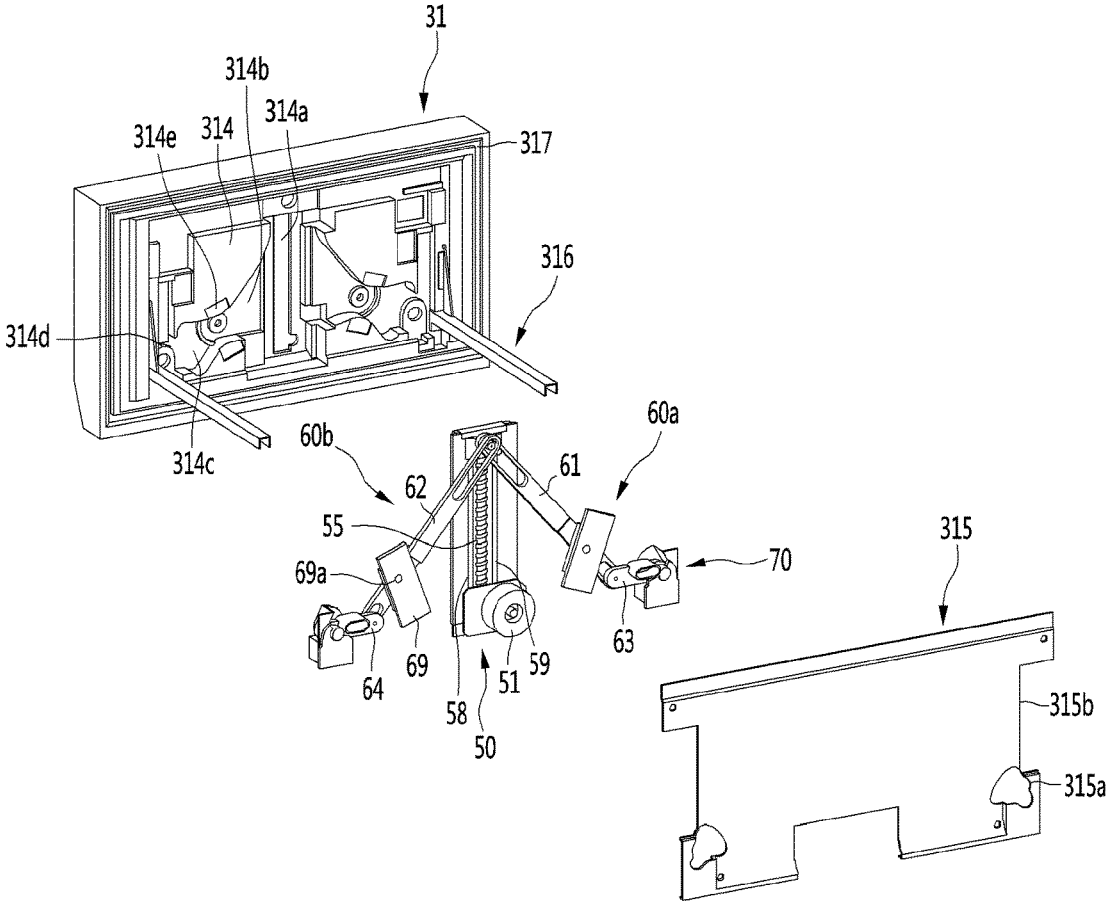
[Fig. 8]
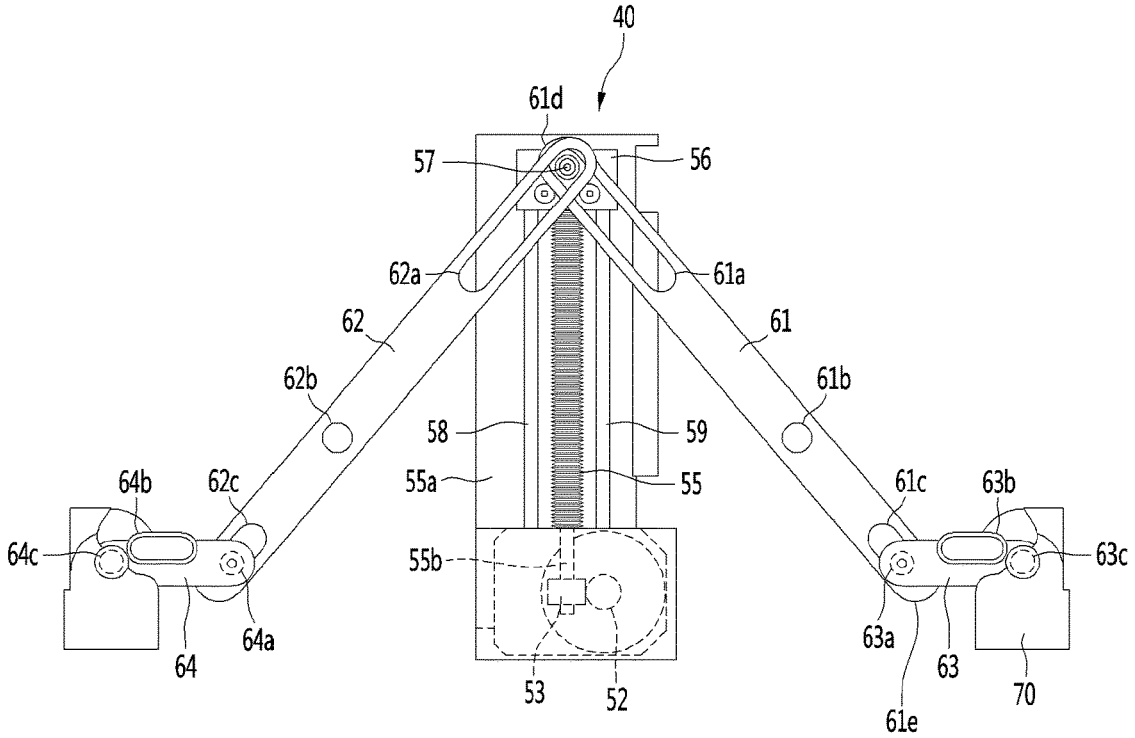

[Fig. 9]
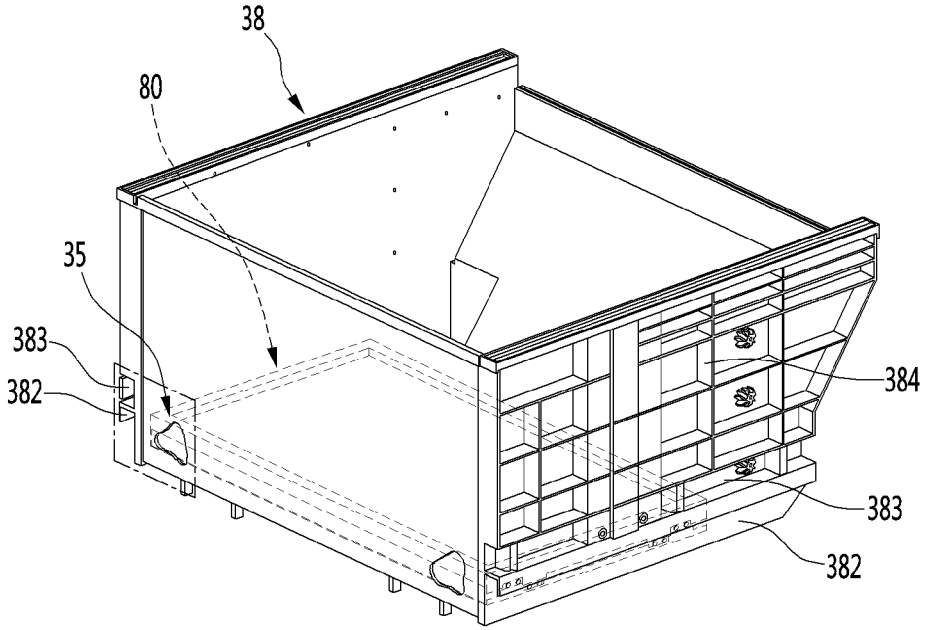

[Fig. 10]
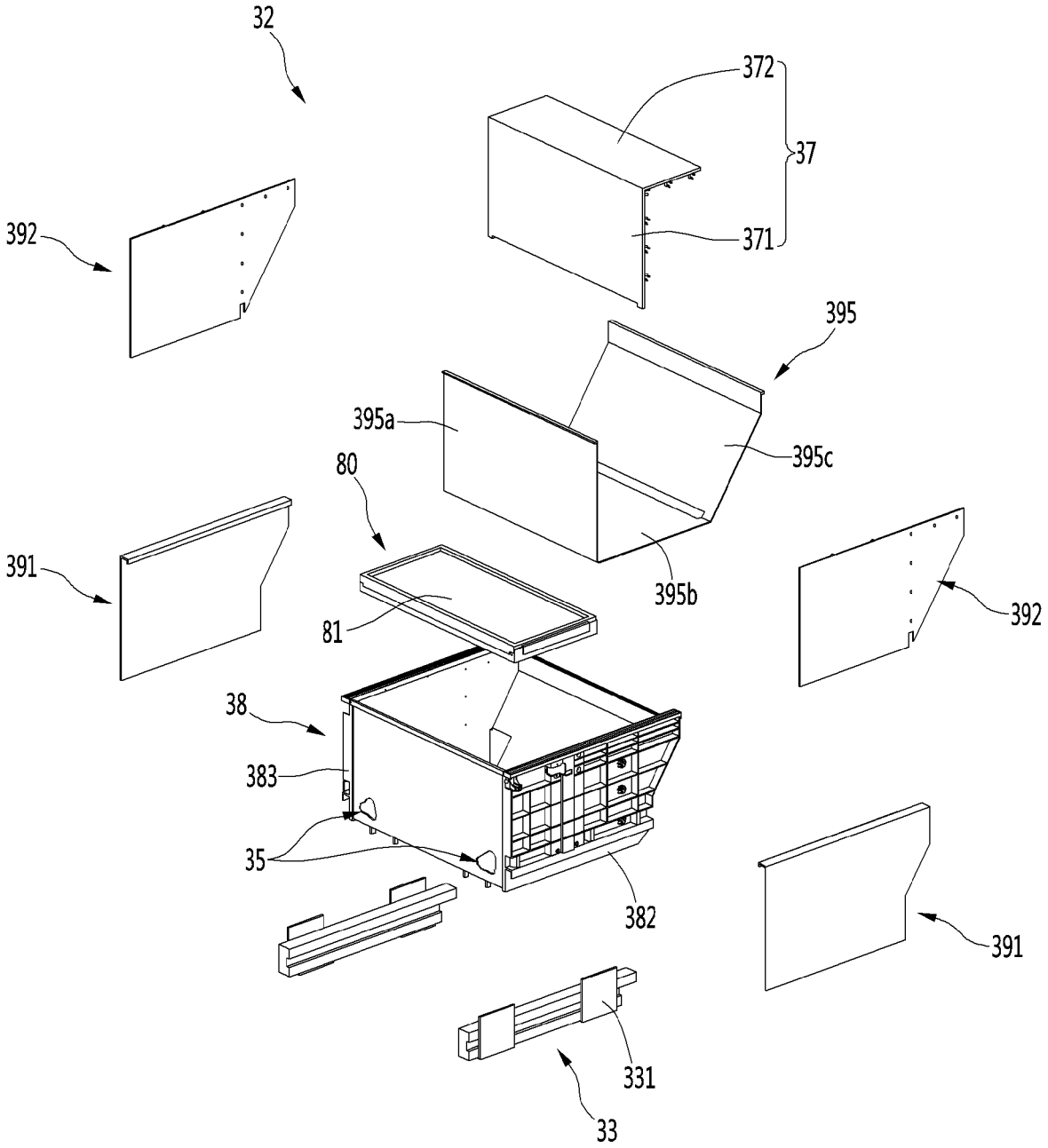

[Fig. 11]
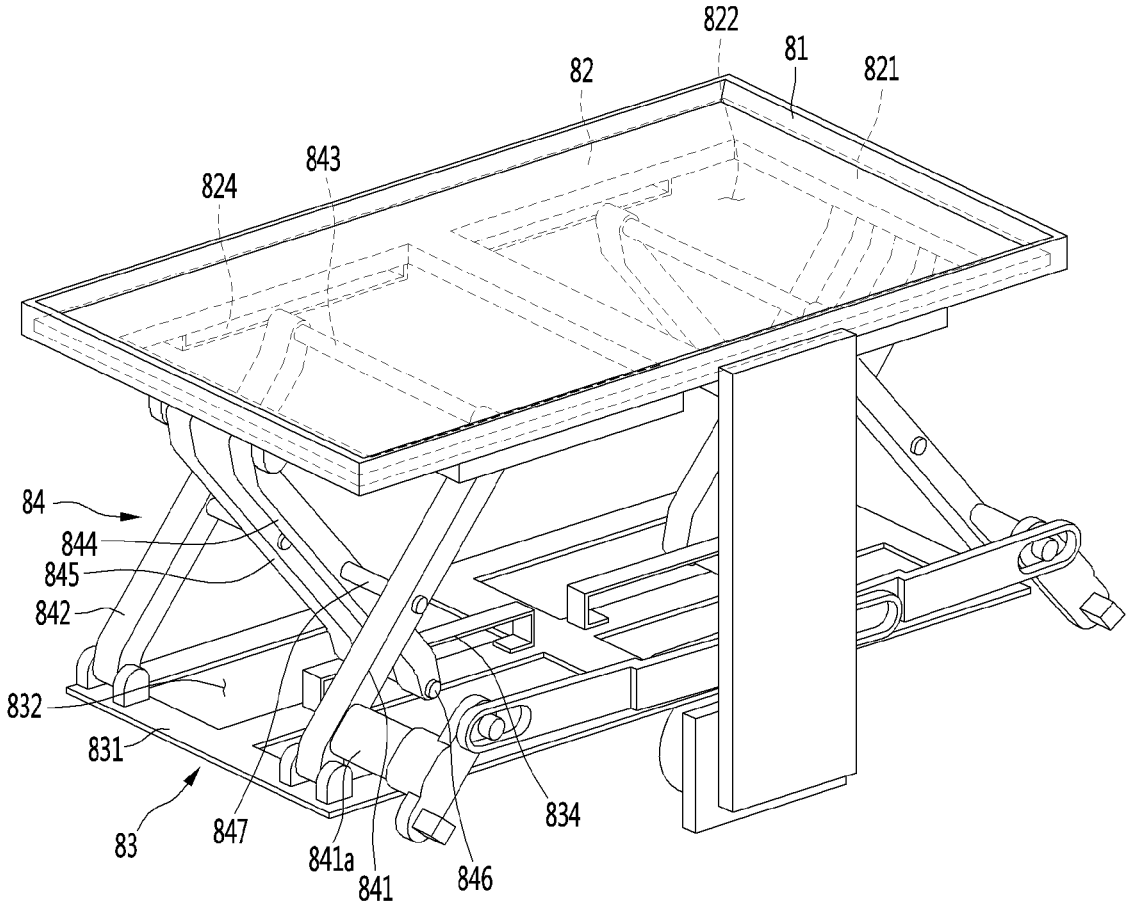

[Fig. 12]
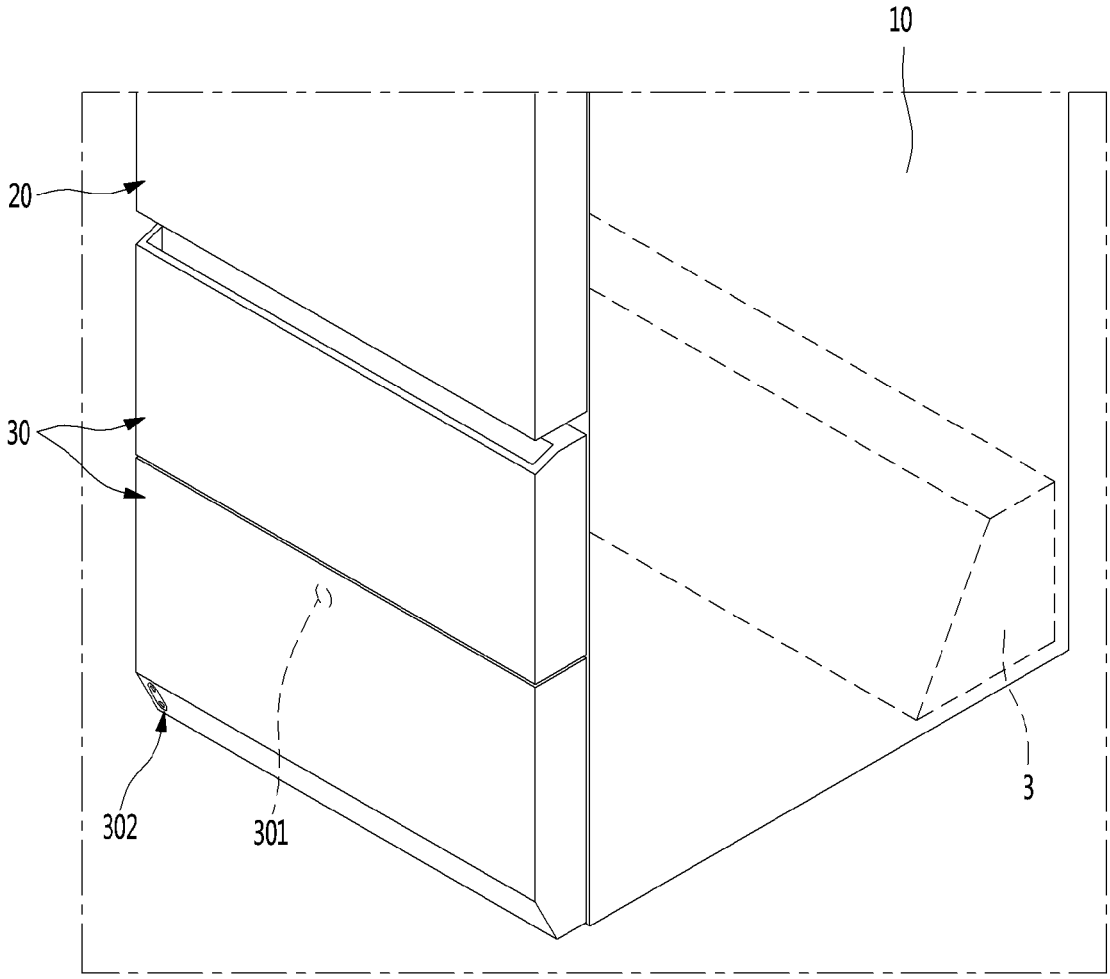

[Fig. 13]
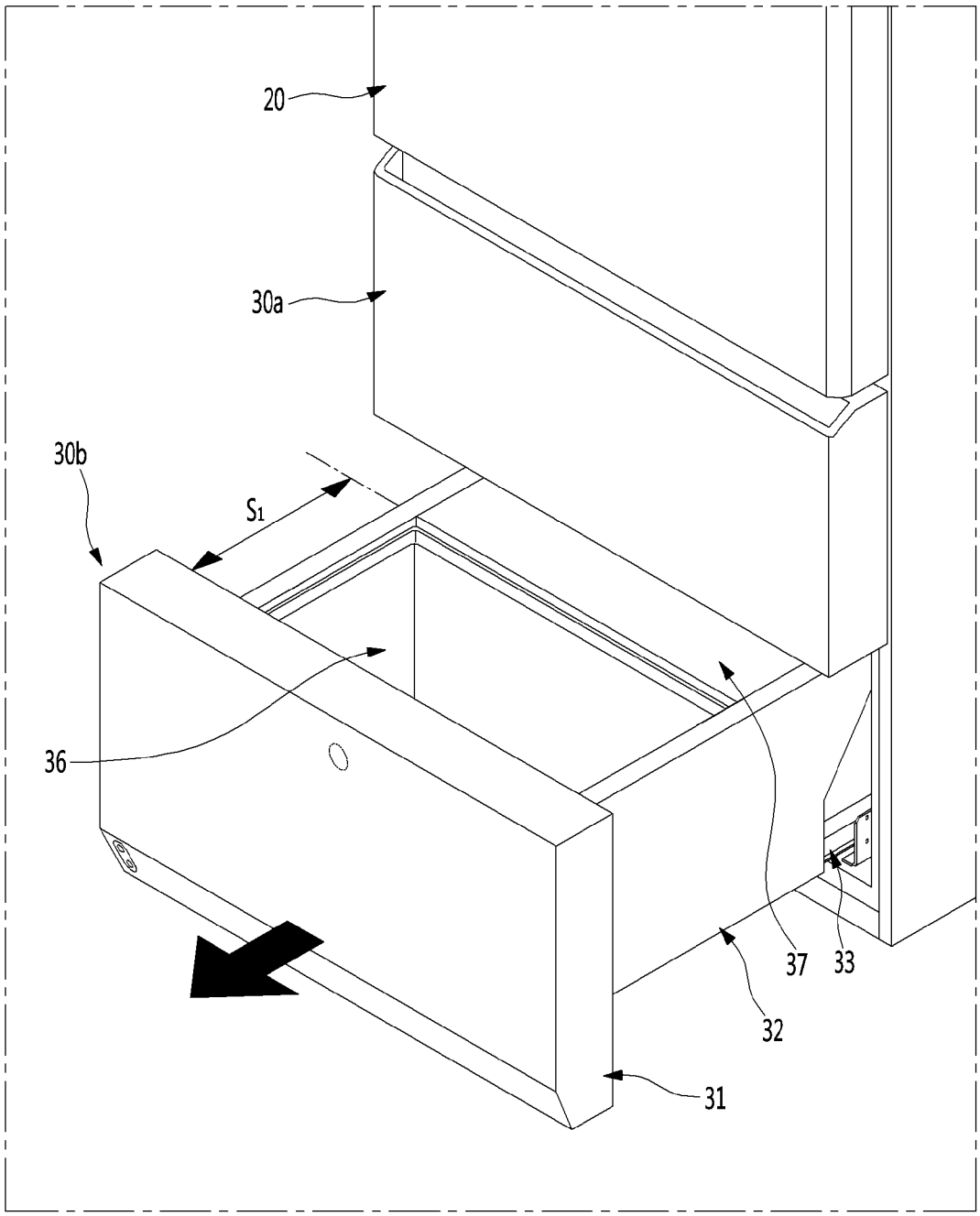

[Fig. 14]
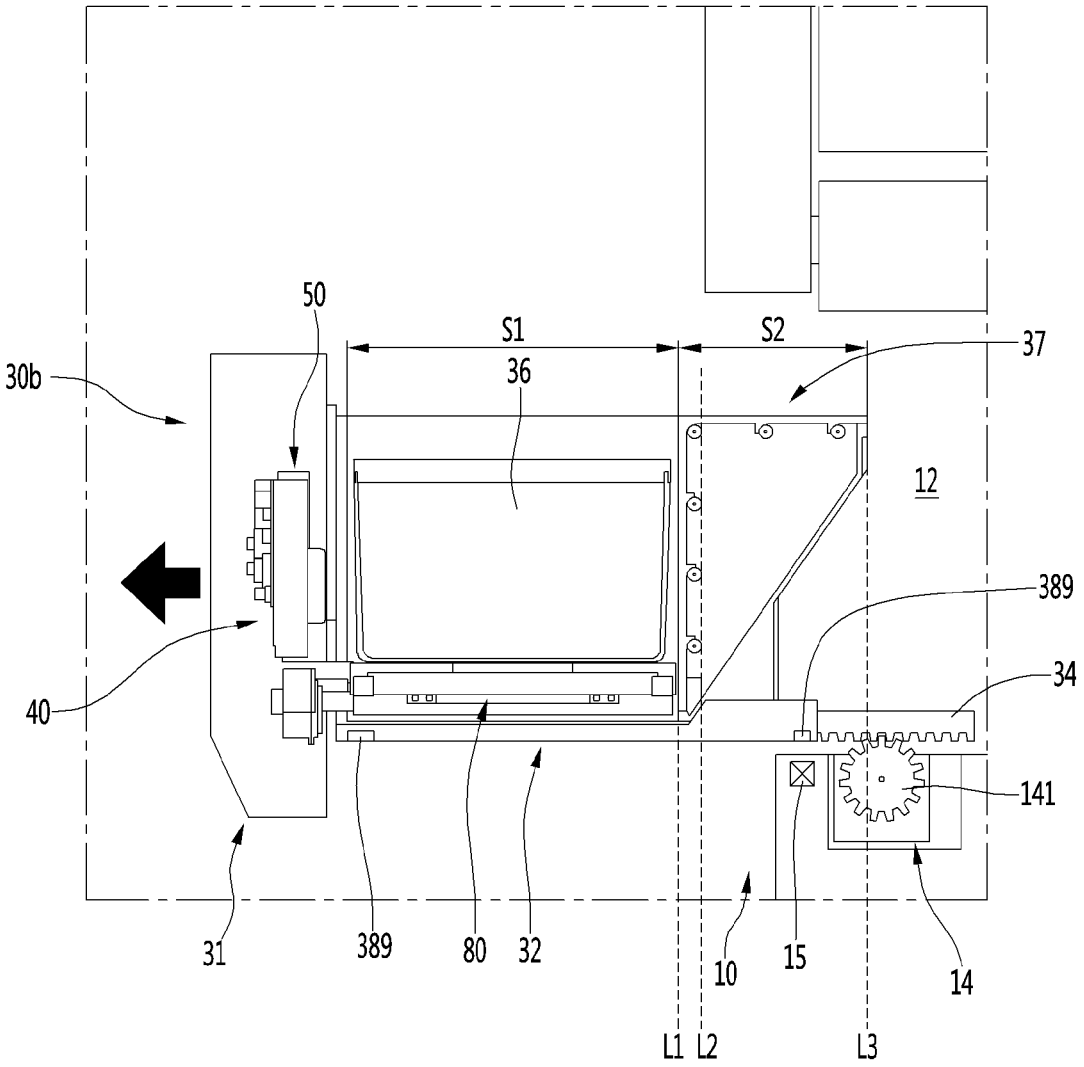

[Fig. 15]
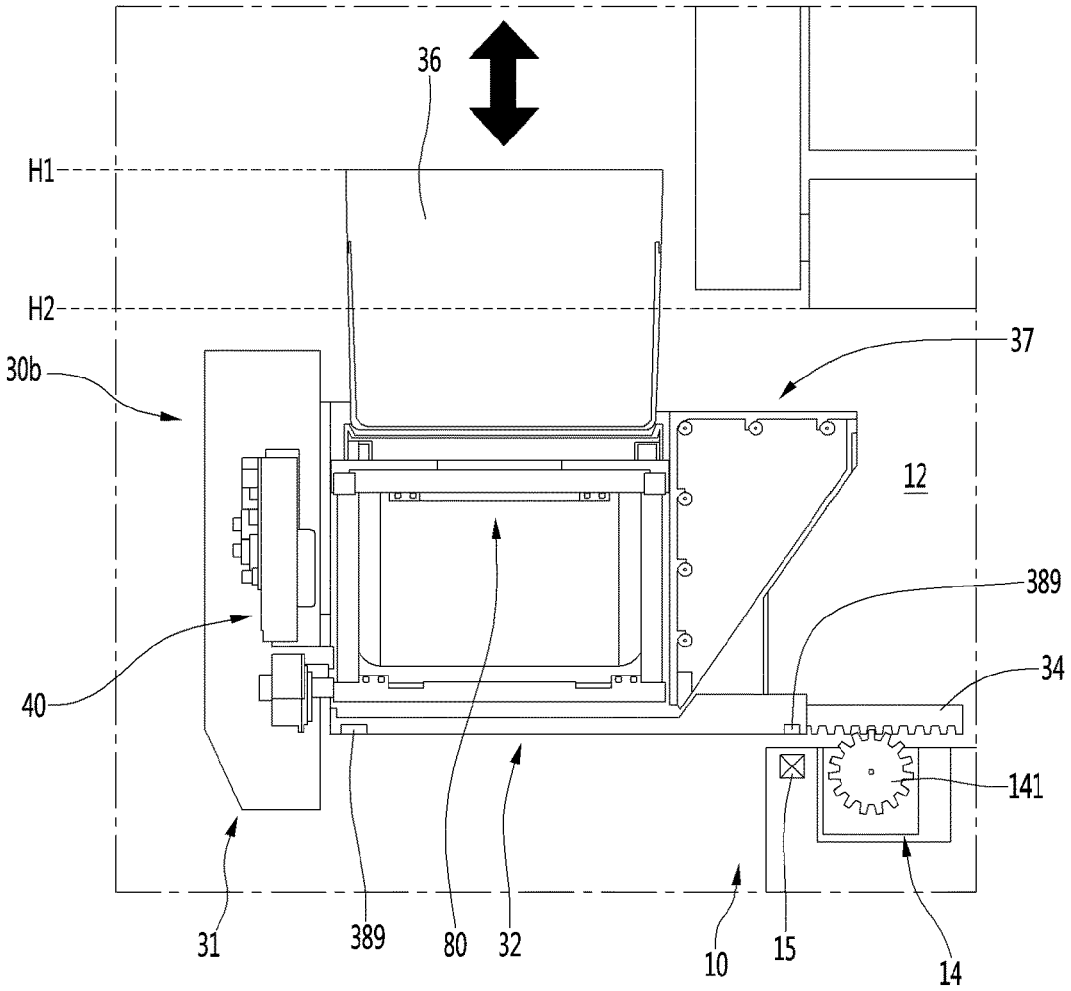
[Fig. 16]
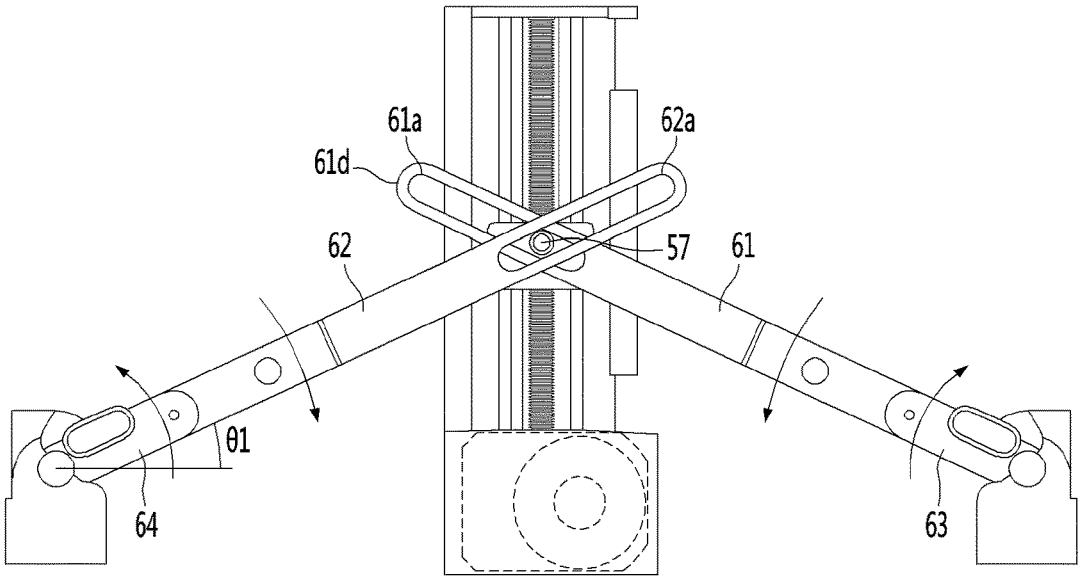

[Fig. 17]
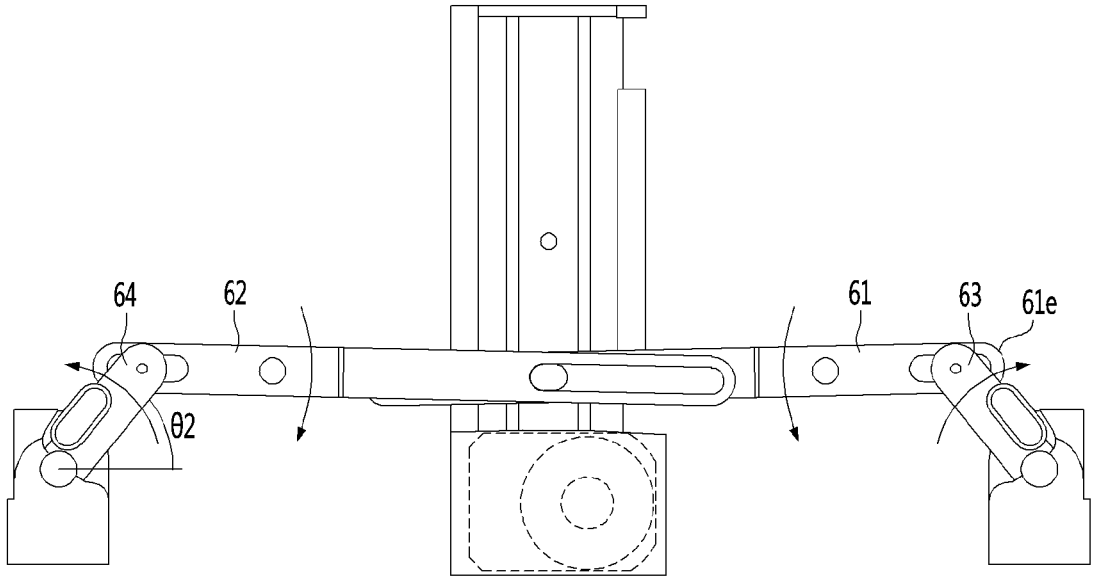
[Fig. 18]
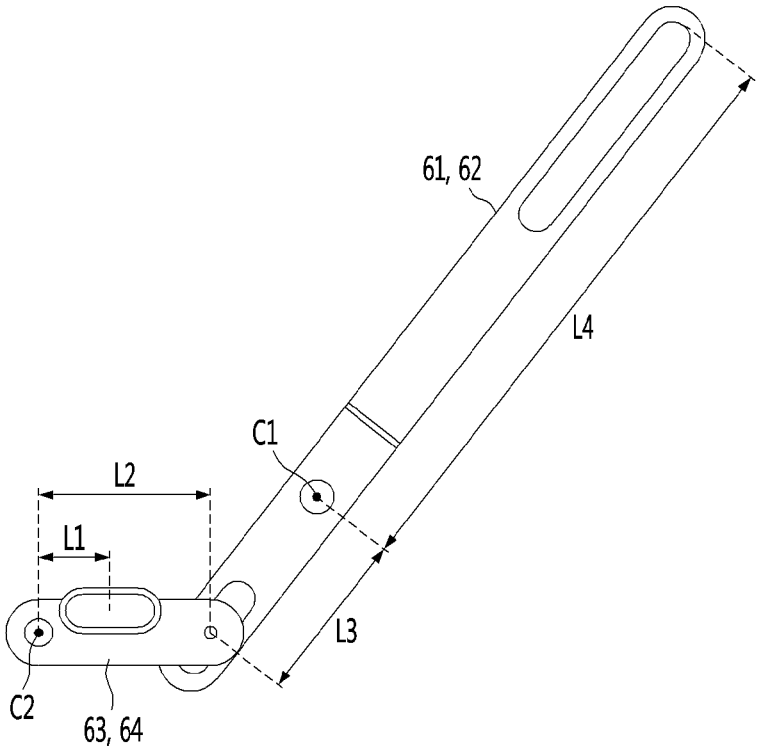

[Fig. 19]
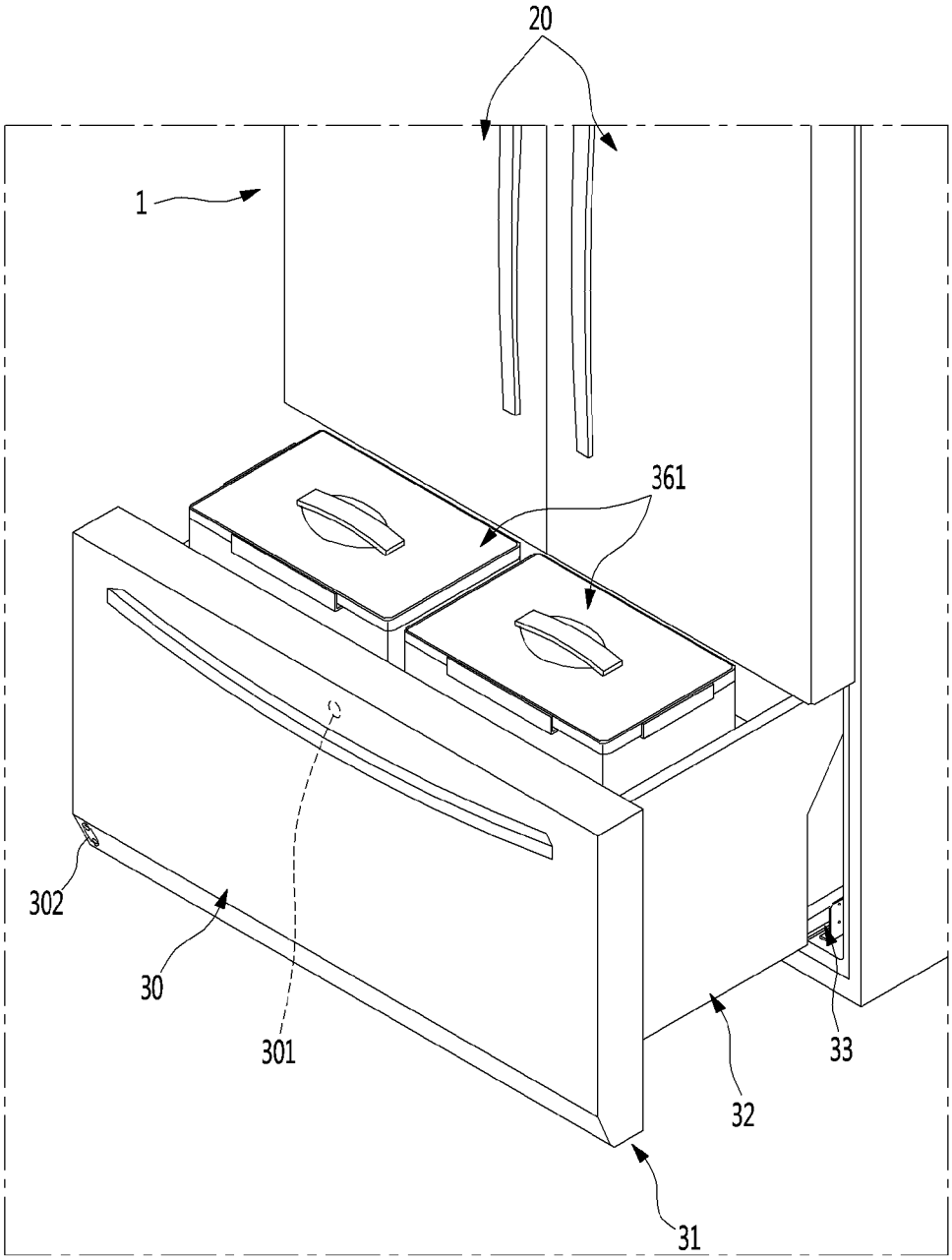

[Fig. 20]
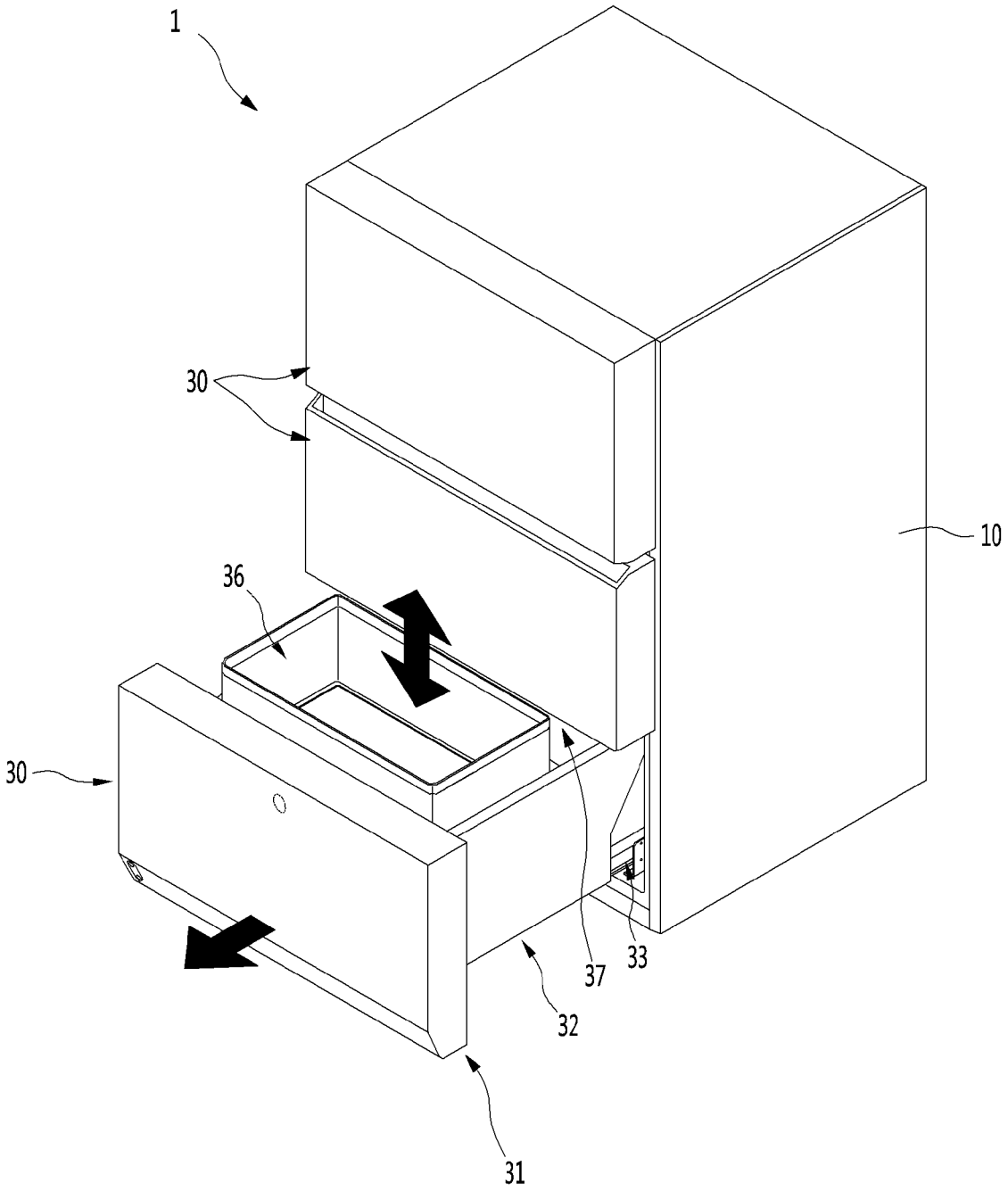

[Fig. 21]
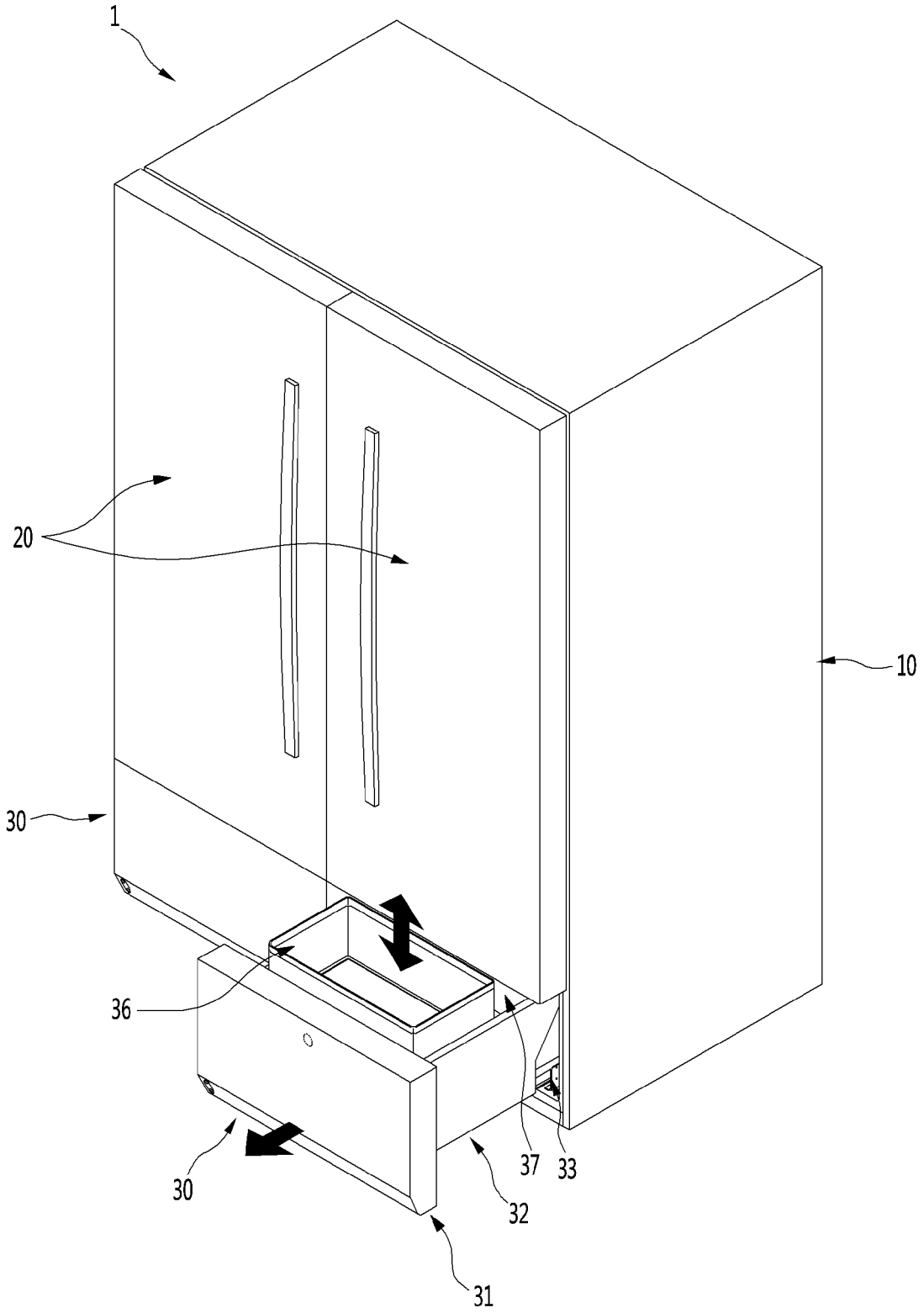

REFRIGERATOR

This application is the National Stage filing under 35 U.S.C. 371 of International Application No. PCT/KR2019/013633, filed on Oct. 17, 2019, which claims the benefit of KR Application No. 10-2018-0125315, filed on Oct. 19, 2018, the contents of which are all hereby incorporated by reference herein in their entirety.

TECHNICAL FIELD

The present disclosure relates to a refrigerator.

BACKGROUND ART

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a refrigerator including a lifting mechanism for moving up or down a bin disposed in a refrigerating compartment has been disclosed in U.S. Pat. No. 9,377,238.

However, in such a related art, the lifting mechanism for lifting has a structure disposed and exposed outside of the bin, which may cause a severe problem with safety. Further, there is a problem in that the external appearance is deteriorated by the exposed structure of the lifting mechanism.

Since a driving unit has a structure exposed outside, when the driving unit is operated, noise can be wholly transmitted to the outside, which may cause complaint of users.

The lifting mechanism is disposed in the refrigerator, so the storage capacity of the refrigerator may be remarkably decreased, which results in a loss of storage capacity of the entire refrigerator, thus, causing a problem in that the storage efficiency is considerably decreased.

The lifting mechanism is fully provided in the refrigerator, so it is required to separate the door and the lifting mechanism in order to provide services for the lifting mechanism, and accordingly, it is difficult to provide the services.

The driving unit of the lifting mechanism has a structure being able to lift the bin by pushing an end of a scissor supporting assembly. Accordingly, when a bin has a large size or a bin is filled with heavy objects, there is a problem in that it is difficult to provide sufficient force for lifting. Obviously, it may be possible to increase the motor of the driving unit in order to solve this problem, but in this case, there is another problem in that the loss of volume in the refrigerator and noise are further increased and the manufacturing cost is also increased.

The lifting mechanism supports a side of the entire bottom of the bin due to the position of the driving unit, so an eccentric load is unavoidably generated when objects are stored in the bin. A severe problem with safety may be caused by an eccentric load that is applied with the door drawn out, and there is also a problem in that elevation cannot be smoothly performed.

The lifting mechanism has a structure in which the whole bin is elevated. In order to elevate the bin, the bin has to be fully drawn out of the storage space of the refrigerator and has to be drawn out to a position where it does not interfere with an upper door and the refrigerator main body to prevent interference with elevation.

DISCLOSURE

Technical Problem

The present embodiment provides a refrigerator in which an electric device for elevation is provided in a door unit and a mechanical device for elevating a drawer unit is provided in a drawer outside a door.

The present embodiment provides a refrigerator that improves an external appearance and safety by preventing exposure of components for elevating a drawer unit.

The present embodiment provides a refrigerator that can secure stable elevation by preventing a drawer unit from sinking due to an eccentric load during elevation.

The present embodiment provides a refrigerator in which a small-sized motor can be used and a drawer unit can be moved up and down by force from the motor.

The present embodiment provides a refrigerator that can minimize noise generation when a drawer is elevated.

Technical Solution

A refrigerator according to an embodiment of the present invention may include: a cabinet having a storage space; a door including a door unit configured to open or close the storage space and a drawer unit configured to provide a receiving space; a driving device disposed at the door unit and configured to provide power; and an elevation device disposed at the drawer unit, connected with the driving device, and configured to move up or down.

The driving device may include: a motor assembly including a driving motor and a movable unit configured to move up and down using power of the motor; and a pair of lever units connected to the movable unit at both sides of the motor assembly.

The motor assembly may further include a screw configured to be rotated by power from the driving motor and extending in an up-down direction. The movable unit can move along the screw.

Each of the pair of lever units may include: a first lever connected to the movable unit; and a second lever connected with the first lever and connected with the elevation device.

The refrigerator may further include a supporting assembly configured to rotatably support the second lever. When the first lever is rotated, the second lever may be rotated in an opposite direction to the first lever.

The movable unit may include a coupling protrusion, and the coupling protrusion may be coupled to a pair of first levers.

The coupling protrusion may be coupled through the pair of first levers in a state in which the pair of first levers overlap each other.

A length of the first lever may be larger than a length of the second lever.

The first lever may be capable of rotating with respect to a shaft while the movable unit moves up and down. The first lever may include a first end and a second end that are longitudinally spaced apart from each other, and the shaft may be positioned between the first end and the second end.

The movable unit may be capable of moving from a first position to a second position that is lower than the first position. The elevation device may move up while the movable unit moves from the first position to the second position.

The first end may be positioned higher than the second end at the first position of the movable unit.

The coupling protrusion may be coupled to the first lever between the shaft and the first end.

A distance between the first end and the shaft may be longer than a distance between the second end and the shaft.

The first lever may include a first slot in which the coupling protrusion is inserted. The first slot may be formed between the shaft and the first end. The first slot may be elongated in a longitudinal direction of the first lever.

The second lever may include a lever protrusion for coupling to the first lever and the first lever may further include a second slot in which the lever protrusion is inserted.

The second slot may be formed between the shaft and the second end.

The second slot may be elongated in the longitudinal direction of the first lever. A length of the first slot may be larger than a length of the second slot.

The second lever may further include a rotary shaft and a connecting portion for connecting the elevation device. The connecting portion may be positioned between the rotary shaft and the lever protrusion.

The movable unit may be positioned higher than the shaft in a state in which the elevation device is located at a lowermost position. When the movable unit moves down, an angle made by the pair of first levers with respect to the coupling protrusion may increase. An angle made by the second lever with respect to a horizontal plane may increase.

The rotary shaft and the lever protrusion of the second lever may be positioned lower than the shaft in a state in which the elevation device is located at a lowermost position.

A refrigerator according to another aspect may include: a cabinet having a storage space; a door including a door unit configured to open or close the storage space and a drawer unit configured to provide a receiving space; a driving device disposed at the door unit and configured to provide power; and an elevation device disposed at the drawer unit, connected with the driving device, and configured to move up or down, in which the driving device may include: a motor assembly including a driving motor and a movable unit configured to move up and down between a first position and a second position by power from the driving motor; a first lever connected to the movable unit; and a second lever configured to be rotated by torque of the first lever, and connected with the elevation device.

A length of the first lever may be larger than a length of the second lever. When the movable unit moves from the first position to the second position, an angle made by the second lever with respect to a horizontal plane may increase and the elevation device may move up.

Advantageous Effects

It is possible to expect the following effects from refrigerators according to proposed embodiments.

A refrigerator according to an embodiment of the present invention is configured such that a portion of a receiving space in a drawer door can be moved up and down with the drawer door drawn out. Accordingly, a user does not need to excessively bend over when putting food into the drawer door disposed at a lower position, so convenience in use can be improved.

In particular, in order to pick up heavy food or a container with food therein, a user has to apply large for to pick up the food or the container, but the elevation device in the drawer door is moved up to a position where use is convenient by the driving device. Accordingly, there in an advantage in that it is possible to prevent an injury on a user and remarkably improve convenience in use.

The driving device that is configured as an electric device for providing power is disposed in the door unit and the elevation device has a structure disposed in the drawer unit, so both of the driving device and the elevation device are not exposed to the outside. Accordingly, safety in use can be secured and the external appearance can be improved.

In particular, since the driving device that is configured as an electric device is disposed in the door unit, it is possible to preclude of approach of a user. Accordingly, it is possible to expect an effect that can prevent occurrence of a safety accident.

Further, since the driving device is disposed in the door, noise is blocked, so there is an advantage in that it is possible to reduce noise in use.

Since the driving device that occupies a considerable part of the entire configuration is disposed at the door unit, it is possible to minimize a loss of storage capacity of the drawer unit. The elevation device has a structure that is folded in compact size and accommodated when it is moved down, so there is an advantage in that it is possible to secure a storage capacity in the refrigerator.

Since the power of the motor is increased by a plurality of levers, it is possible to move up and down the drawer unit while decreasing the size of the motor, so it is possible to prevent deterioration of the insulating ability of the door unit. That is, the larger the size of the motor, the smaller the thickness of the insulator in the door unit, but, according to the present embodiment, the size of the motor can be reduced. Accordingly, it is possible to minimize reduction of the thickness of the insulator.

Further, according to the present embodiment, since the power of the motor is transmitted to two levers through one screw, there is advantage in that the structure of the driving device is simplified and a loss of work is reduced while the power of the motor is transmitted.

Further, since two levers provide elevation force to the elevation device, there is an advantage in that it is possible to secure horizontal moving-up and down always without biasing or sinking of the elevation device even without separate control or configuration.

It is possible to expect the following effects from refrigerators according to proposed embodiments.

A refrigerator according to an embodiment of the present invention is configured such that a portion of a receiving space in a drawer door can be moved up and down with the drawer door drawn out. Accordingly, a user does not need to excessively bend over when putting food into the drawer door disposed at a lower position, so convenience in use can be improved.

In particular, in order to pick up heavy food or a container with food therein, a user has to apply large for to pick up the food or the container, but the elevation device in the drawer door is moved up to a position where use is convenient by the driving device. Accordingly, there in an advantage in that it is possible to prevent an injury on a user and remarkably improve convenience in use.

The driving device that is configured as an electric device for providing power is disposed in the door unit and the elevation device has a structure disposed in the drawer unit, so both of the driving device and the elevation device are not exposed to the outside. Accordingly, safety in use can be secured and the external appearance can be improved.

In particular, since the driving device that is configured as an electric device is disposed in the door unit, it is possible to preclude of approach of a user. Accordingly, it is possible to expect an effect that can prevent occurrence of a safety accident.

Further, since the driving device is disposed in the door, noise is blocked, so there is an advantage in that it is possible to reduce noise in use.

Since the driving device that occupies a considerable part of the entire configuration is disposed at the door unit, it is possible to minimize a loss of storage capacity of the drawer unit. The elevation device has a structure that is folded in compact size and accommodated when it is moved down, so there is an advantage in that it is possible to secure a storage capacity in the refrigerator.

DESCRIPTION OF DRAWINGS

FIG. 1 is a front view of a refrigerator according to an embodiment of the present invention.

FIG. 2 is a cross-sectional view schematically showing an elevated state of a lower drawer door of the refrigerator according to an embodiment of the present invention.

FIG. 3 is a perspective view when a container of the lower drawer door is separated.

FIG. 4 is an exploded perspective view seen from the front when a drawer unit and a door unit of the lower drawer door are separated.

FIG. 5 is a rear perspective view of the door unit.

FIG. 6 is a rear view when a door cover of the door unit is removed.

FIG. 7 is an exploded perspective view of the door unit.

FIG. 8 is a front view of a driving device according to the present embodiment.

FIG. 9 is a perspective view of the drawer unit according to an embodiment of the present invention.

FIG. 10 is an exploded perspective view of FIG. 9.

FIG. 11 is a perspective view showing the state when an elevation device according to an embodiment of the present invention has be moved up.

FIG. 12 is a perspective view showing the state when the lower drawer door is closed.

FIG. 13 is a perspective view showing the state when the lower drawer door is fully open.

FIG. 14 is a cross-sectional view of the drawer door in the state when the container of the drawer door is fully moved down.

FIG. 15 is a cross-sectional view of the drawer door in the state when the container of the lower drawer door is fully moved up.

FIG. 16 is a view showing the driving device before the elevation device is fully moved up.

FIG. 17 is a view showing the driving device with the elevation device fully moved up.

FIG. 18 is a view showing the relationship of rotational center and length of a first lever and a second lever.

FIG. 19 is a perspective view of a refrigerator according to another embodiment of the present invention.

FIG. 20 is a perspective view of a refrigerator according to another embodiment of the present invention.

FIG. 21 is a perspective view of a refrigerator according to another embodiment of the present invention.

MODE FOR INVENTION

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment, FIG. 2 is a schematic view illustrating a state in which a lower drawer door of the refrigerator is inserted and withdrawn and is elevated, and FIG. 3 is a perspective view when a container of the lower drawer door is separated.

Referring to FIGS. 1 to 3, the refrigerator 1 may have a cabinet 10 defining a storage space and a door 2 covering an opened front surface of the cabinet 10.

The storage space of the cabinet 10 may be divided into a plurality of spaces. For example, an upper space of the cabinet 10 may be provided as a refrigerating compartment 11, and a lower space of the cabinet 10 may be provided as a freezing compartment 12. Each of the upper space and the lower space may be provided as an independent space that is maintained at a different temperature, except for the refrigerating compartment and the freezing compartment. The upper space and the lower space may be called an upper storage space 11 and a lower storage space 12.

The door 2 may comprise a rotation door 20 opening and closing the upper space through rotation thereof and a drawer door 30 opening and closing the lower space by being inserted or withdrawn in a drawer type. The lower space may be vertically divided again. The drawer door 30 may comprise an upper drawer door 30*a* and a lower drawer door 30*b*.

An outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

The rotation door 20 is disposed at an upper position, so it can be referred to as an upper door, and the drawer door 30 is disposed at a lower position, so it can be referred to as a lower door.

A display 21 may be disposed on one side of a front surface of the rotation door 20. The display 21 may have a liquid crystal display structure or a 88 segment structure. Also, when the outer appearance of the door 2 is made of the metal material, a plurality of fine holes are punched in the door 2 to display information by using light passing therethrough.

A manipulation part 22 that is capable of manipulating automatic rotation or withdrawal of the upper door 2 or the lower door 2 may be provided on one side of the rotation door 20.

The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation of a container within the drawer door.

A manipulation part 301 may also be provided on the drawer door 30. The manipulation part 301 may be disposed on one side of the lower drawer door 30*b* that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30*b* to illuminate an image on a bottom surface and thereby to output a virtual switch and to input an operation in such a manner that the user approaches a corresponding area.

The lower drawer door 30*b* may be automatically inserted and withdrawn according to the manipulation of the manipulation part 301. Also, a food or container 36 within the lower drawer door 30*b* may be elevated in a state in which the drawer door 30 is withdrawn by the manipulation of the manipulation part 301.

That is, the automatic insertion and withdrawal and/or automatic elevation of the lower drawer door 30*b* may be performed by at least one of a plurality of manipulation devices 22, 301, 302, and 303. As necessary, only one of the plurality of manipulation devices 22, 301, 302, and 303 may be provided in the refrigerator.

In particular, an inclined portion 311*a* is formed at an angle at the lower portion of the front surface of the lower drawer door 30*b* and manipulation device 302 may be mounted on the inclined portion 311*a*. The manipulation device 302 includes a projector light, which can output image, a proximity sensor, etc., so it can project a virtual switch in an image type on a floor and can sense whether a user has selected the virtual switch through the proximity sensor.

Obviously, the manipulation device 302 may simply include only a proximity sensor. Automatic drawing-in and out and/or elevation of the lower drawer door 30*b* can be manipulated by manipulation of the manipulation device 302.

A manipulation device 303 may be provided on the top surface of the lower drawer door 30*b*. When a manipulation device 303 is provided on the top surface of the lower drawer door 30*b*, the manipulation device is not exposed to the outside when the lower drawer door 30*b* is closed, so the manipulation device cannot be manipulated. Accordingly, the manipulation device 303 can be used to move up and down the lower drawer door 30*b*.

Meanwhile, since there are provided the manipulation devices 22, 301, 302, and 303 and they can be used for drawing in and out and moving up and down the lower drawer door 30*b*, and drawing-in and out and moving-up and down can be manipulated in accordance with manipulation combination of sequential manipulation of the plurality of manipulation devices 22, 301, and 302.

In order to receive food received in the lower drawer door 30*b*, it is possible to draw out forward the lower drawer door 30*b* and then move up the container 36 in the lower drawer door 30*b*.

On the other hand, the container 36 may have a predetermined height. Since the container 36 is seated on an elevation device 80 to be described below, when the elevation device 80 is moved up, the height of the container 36 can be added to the height of the elevation device 80. Accordingly, when the elevation device 80 is moved up, it may be positioned at a point where a user easily approaches the container 36 or lifts the container 36.

Accordingly, the container 36 can be fully received in the drawer unit 32 when the lower drawer door 30*b* is drawn in and out, and when the elevation device 80 is moved up, it may be positioned at a higher position than the lower space 12.

Meanwhile, the shape of the container 36 is not limited, but may be a shape corresponding to the size of a front space S1. Further, it may be preferable that the container 36 is configured to have a predetermined height such that food received therein is not separated even though the elevation device 80 is moved up.

According to this manipulation, it is possible to more easily lift and use the food or the container 36 in the drawer door 30 disposed at the lowermost position.

The lower drawer door 30*b* may be automatically drawn in and out forward and rearward by a drawing motor 14 and a pinion 141 disposed in the cabinet 10, and a drawing rack 34 disposed on the bottom surface of the lower drawer door 30*b*.

The container in the lower drawer door 30*b* can be moved up and down by the driving device 40 and the elevation device 80 disposed at the lower drawer door 30*b*.

Hereafter, the lower drawer door 30*b* and the configuration for operation of the lower drawer door 30*b* of the present invention are described in more detail, and unless specifically stated, the lower drawer door 30*b* is referred to as a "drawer door" or a "door".

Meanwhile, embodiments of the present invention are not limited to the number and shape of drawer doors and can be applied to all of refrigerators having a door that is drawn in and out in a drawer type in a lower storage space.

FIG. 4 is an exploded perspective view seen from the front when a drawer unit and a door unit of the lower drawer door are separated.

Referring to FIGS. 1 to 4, the door 30*b* may include a door unit 31 opening and closing the storage space and a drawer unit 32 coupled to the rear surface of the door unit 31 to be drawn in and out together with the door unit 31.

The door unit 31 is exposed outside the cabinet 1 and can form the external appearance of the refrigerator 1 and the drawer unit 32 is disposed in the cabinet 10 and can form a receiving space. The door unit 31 and the drawer unit 32 are combined with each other, so they can be drawn in and out forward and rearward together.

The drawer unit 32 is disposed on the rear surface of the door unit 31 and can form a space where food or a container to be stored is received. The inside of the drawer unit 32 may form a receiving space that is open upward, and the external appearance of the drawer unit 32 may be formed by several plates (see 391, 392, and 395 in FIG. 10).

The several plates 391, 392, and 395 may be made of a metal material such as stainless steel and are disposed not only outside, but also inside the drawer unit 32 such that the entire drawer unit 32 has the texture of stainless steel or a texture like stainless steel.

A machine room 3 where a compressor, a condenser, etc. constituting a refrigeration cycle are disposed may be disposed behind the door 30*b* when the door 30*b* is drawn in. Accordingly, the rear portion of the drawer unit 32 may be formed in a shape in which the upper end protrudes rearward further than the lower end, and the rear surface of the drawer unit 32 may include an inclined surface 321.

Drawing rails 33 that can guide the door 30*b* being drawing in and out may be disposed on both sides of the drawer unit 32. The door 30*b* can be mounted on the cabinet 10 to be able to be drawn in and out by the drawing rails 33. The drawing rails 33 are covered by an outer side plate 391, whereby they cannot be exposed to the outside. The drawing rails 33 may be configured in a rail structure that can be stretched in multiple stages.

The drawing rails 33 may have a rail bracket 331 and the rail bracket 331 may extend to both sides of the drawer unit 32 from sides of the drawing rails 33. The rail bracket 331 may be coupled and fixed to a wall in the refrigerator. Accordingly, the drawer unit 32, that is, the door 30*b* can be mounted on the cabinet 10 to be able to be drawn in and out by the drawing rails 33.

Further, the drawing rails 33 may be disposed on the lower ends of both sides of the drawer unit 32, and accordingly, the drawing rails 33 may be understood as being disposed on the bottom surface of the drawer unit 32. Accordingly, the drawing rails 33 are disposed on the lower ends of both sides of the drawer unit 32 and may be referred to as under rails.

A drawing rack 34 may also be disposed on the bottom surface of the drawer unit 32. The drawing rack 34 may be disposed on both left and right sides, and enables the door 30 to be automatically drawn in and out in cooperation with the drawing motor 14 mounted in the cabinet 10. That is, when manipulation is input through the manipulation parts 22 and 301, the drawing motor 14 is driven, so the door 30*b* can be drawn in and out along the drawing racks 34. In this case, the door 30 can be stably drawn in and out by the drawing rails 33.

Obviously, the drawing rack 34 may not be disposed on the drawer unit 32 and the drawer unit 32 may be configured such that a user draws in and out the door 30*b* in person by holding and pushing or pulling a side of the door unit 31.

Meanwhile, the inside of the drawer unit 32 may be divided into a front space S1 and a rear space S2. The elevation device 80 that is moved up and down and the container 36 that is seated on the elevation device 80 and moved together with the elevation device 80 may be disposed in the front space S1.

The container 36 is shown in a basket shape with an open top, but may have a closed box structure such as a Kimchi container, and several containers may be stacked or disposed in parallel.

When the door 30*b* is drawn out, the entire drawer unit 32 cannot be drawn out of the storage space due to a limitation in the drawing-out distance of the door 30. Further, at least the front space S1 is drawn out of the storage space and the entire or a portion of the rear space S2 is positioned in the storage space in the cabinet 1.

The larger the drawing-out distance of the door 30, the lager the moment that is applied to the door 30 when the door 30 has been drawn out, so it is difficult to maintain a stable state and the drawing rails 33 or the drawing racks 34 may be caused to be deformed or damaged. Accordingly, it is required to limit the drawing-out distance of the door 30.

The drawing-out distance of the door 30 may be limited by the drawing racks 34 or the drawing rails 33.

The elevation device 80 and the container 36 are accommodated in the front space S1 and the elevation device 80 can move up and down food or the container 36 seated on the elevation device 80 while vertically moving up and down. The elevation device 80 may be disposed under the container 36, and when the container 36 is mounted, the elevation device 80 can be covered by the container 36. Accordingly, even any component of the elevation device 80 is not exposed to the outside.

A separate drawer cover 37 may be disposed in the rear space S2. The front space S1 and the rear space S2 can be divided by the drawer cover 37. When the drawer cover 37 is mounted, the front surface and the top surface of the rear space S2 are covered such that a space that is not used is not exposed to the outside.

However, when the drawer cover 37 is separated, it is possible to approach the rear space S2 and to put food into the rear space S2. In order to use the rear space S2, a separate pocket or a container corresponding to the shape of the rear space may be disposed in the rear space S2.

In order to use the entire space in the drawer unit 32, the elevation device 80 in the drawer unit 32 can be simply separated and mounted, and it may be possible to use the entire internal space of the drawer unit 32 by separating the elevation device 80 and the drawer cover 37.

The external appearances of the inner side and the outer side of the drawer unit 32 may be formed by the plates (see 391, 392, and 395 in FIG. 10) and it may be possible to cover the components mounted in the drawer unit 32 so that the external appearances of the inside and outside can be shown clean. There may be provided several plates (see 391, 392, and 395 in FIG. 10) and may be made of a stainless material, thereby being able to provide a more luxurious and clean external appearance.

On the other hand, the door unit 31 and the drawer unit 32 that constitute the door 30*b* may have structures that can be combined with and separated from each other. It is possible to improve workability and to more conveniently provide services through the separable structure of the door unit 31 and the drawer unit 32.

The rear surface of the door unit 31 and the front surface of the drawer unit 32 can be coupled to each other, and when the door unit 31 and the drawer unit 32 may be configured to be able to provide power for moving up and down the elevation device 80 when they are combined.

The driving device (see 40 in FIG. 6) for moving up and down the elevation device 80 may be disposed on the door unit 31, and the door unit 31 and the drawer unit 32 may be selective connected.

In particular, the driving unit (see 40 in FIG. 6) disposed on the door unit 31 may be composed of components that are operated by input power and components for transmitting power to the elevation device 80. Accordingly, when a service for the driving unit (see 40 in FIG. 6) is required, it is possible to take measures by separating the door unit 31 and it is possible to easily take measures by replacing only the door unit 31.

The door unit 31 and the drawer unit 32 may be combined by a pair of door frames 316 disposed on both sides.

The door frame 316 may include a door coupling part 316*a* vertically extending and coupled to the door unit 31, and a drawer coupling part 316*b* extending rearward from the lower end of the door coupling part 316*a*.

The door coupling part 316*a* may be coupled to the door unit 31 by a separate coupling member and may be coupled to a side of the door unit 31 by a simple coupling structure. The drawer coupling part 316*b* is inserted in both sides of the drawer unit 32 and may be disposed adjacent to the drawing rails 33.

With the door coupling part 316*a* is coupled to the door unit 31, the drawer coupling part 316*b* can support the drawer unit 32 by being inserted in the drawer unit 32. The drawer coupling part 316*b* may be coupled to the drawer unit 32 by a separate coupling member or may be coupled by a shape-fitting structure.

In order that the driving device 40 and the elevation device 80 can be connected when the door unit 31 and the drawer unit 32 are combined, a drawer opening 35 exposing a portion of the elevation device 80 may be formed on the front surface of the drawer unit 32.

Meanwhile, the door unit 31 is formed to be able to substantially open and close the storage space of the cabinet 10 and simultaneously form the front external appearance of the refrigerator 1.

The external appearance of the door unit 31 may be formed by an out case 31 that forms the front surface and a portion of the circumferential surface, a door liner 314 that forms the rear surface, and an upper deco 312 and a lower deco 313 that form the top surface and the bottom surface. The inside of the door unit 31 between the out case 311 and the door liner 314 may be filled with an insulator (not shown).

Hereafter, the door unit 31 constituting the door 30*b* and the driving assembly are described in more detail with reference to the drawings.

FIG. 5 is a rear perspective view of the door unit and FIG. 6 is a rear view in the state when a door cover of the door unit is removed. FIG. 7 is an exploded perspective view of the door unit. FIG. 8 is a front view of a driving device according to the present embodiment.

FIG. 8 shows the driving device with the elevation device moved down to the lowermost position.

Referring to FIGS. 5 to 7, the front surface of the door unit 31 is formed by the out case 311 and rear surface may be formed by the door liner 314.

The driving device 40 for operating the elevation device 80 may be disposed in the door unit 31. The driving device 40 is disposed in the door unit 31, but is not embedded in the insulator and is disposed in a space formed by the door liner 314, and may be covered by the door cover 315 not to be exposed to the outside.

In detail, an insulator may be disposed between the out case 311 and the door liner 314 and insulates the inside of the storage space 12.

A plurality of recessions that is recessed inward may be formed on the door liner 314. The door recessions may be formed in a shape corresponding to the shape of the driving device 40 and may be recessed toward the out case 311.

The driving device 40 may include a motor assembly 50 and a pair of lever units 60*a* and 60*b* connected to the motor assembly 50. The lever units 60*a* and 60*b* can be respectively supported by supporting assemblies 70.

The lever unit 60*a* and 60*b* may include first levers 61 and 62 connected to the motor assembly 50 and second levers 63 and 64 connected to the first levers 61 and 62 and the supporting assemblies 70, respectively.

The lever unit 60*a* and 60*b* may be symmetrically disposed at both sides of with the motor assembly 50 therebetween.

The door recessions may include a first recession 314*a* in which the motor assembly 50 is accommodated. The first recession 314*a* may extend up and down.

The door recessions may further include a pair of second recessions 314*b* extending at both sides of the first recession 314*a*.

The first levers 61 and 62 may be positioned in the second recessions 314*b*. The second recessions 314*b* provide a space where the first levers 61 and 62 can be moved.

The second recessions 314*b* may be formed such that the up-down width decreases toward the sides of the first recession 314*a*.

The door recessions may further include a pair of third recessions 314*c* laterally extending from the second recessions 314*b*. The second levers 63 and 64 may be positioned in the third recessions 314*c*. The third recessions 314*c* provide a space where the second levers 63 and 64 can be moved.

The door recessions may further include a pair of fourth recessions 314*d* laterally extending from the third recessions 314*c*. The supporting assemblies 70 may be positioned in the fourth recessions 314*d*.

The driving device 40 may further include a lever support 69 fastened to the door unit 31 and rotatably supporting the first levers 61 and 62. The lever support 69 may include a shaft 69*a* disposed through the first levers 61 and 62. The shaft 69*a* provides a rotational center for rotation of the first levers 61 and 62.

The door recessions may further include a fifth recession 314*e* in which the lever support 69 is seated. The lever support 69 can be seated in the fifth recession 314*e* with the first levers 61 and 62 seated in the second recessions 314*b*.

Meanwhile, the driving device 40 may be covered by the door cover 315 and may be disposed in the door unit 31. Power of the driving device 40 can be transmitted to the elevation device 80. In this configuration, the driving device 40 can transmit power simultaneously to both left and right sides of the elevation device 80 such that the elevation device 80 can be moved up and down with both left and right sides horizontally positioned without inclining or leaning to a side even under any situation.

The door cover 315, which is for forming the external appearance of the rear surface of the door unit 31, covers the driving device 40 mounted on the door unit 31.

The door cover 315 may be formed in a plate shape and can cover the driving device 40 such that the driving device 40 is not exposed when the driving device 40 is mounted.

The side cut portions 315*b* may be formed at both left and right side ends of the door cover 315. The side cut portions 315*b* enables the door frame 316 to be exposed.

A door gasket 317 may be disposed around the rear surface of the door unit 31, and the door gasket 317 is in contact with the front surface of the cabinet 10 with the door 30 closed, thereby being able to achieve a hermetic state.

The door cover 315 may further include a cover opening 315*a*. The second levers 64 and 64 or a portion of the elevation device 80 can pass through the cover opening 315*a*.

Meanwhile, the door assembly 50 may include a driving motor 51 and a transmission unit that transmits power of the driving motor 51 to the lever units 60*a* and 60*b*.

The driving motor 51 provides power for moving up and down the elevation device 80 and can rotate forward and backward. Accordingly, when an elevation signal of the elevation device 80 is input, it is possible to provide power for moving up and down the elevation device 80 by rotating forward or backward. It can be stopped when a load of the driving motor 51 or a stop signal by sensing of a sensor is input.

The transmission unit may include a first gear 52 connected to the driving motor 51, a second gear 53 engaged with the first gear 52, and a screw 55 connected with the second gear 53.

The axial line of the driving motor 51 may horizontally extend and the screw 55 may extend up and down. The rotational center line of the second gear 53 may vertically extend.

Accordingly, the first gear 52 and the second gear 53 change the transmission direction of the power of the driving motor 51. To this end, for example, the first gear 52 and the second gear 53 may be worm gears. Alternatively, the first gear 52 and the second gear 53 may be bevel gears or helical gears.

A gear connection part 55*b* is disposed under the screw 55 and the second gear 53 is coupled to the gear connection part 55*b*. Accordingly, when the second gear 53 is rotated, the screw 55 is also rotated.

The motor assembly may further include a movable unit 56 through which the screw 55 is coupled.

The movable unit 56 can vertically move along the screw 55 when the screw 55 is rotated.

The lever units 60*a* and 60*b* can be coupled to the movable unit 56.

The movable unit 56 may include a coupling protrusion 57. The coupling protrusion 57 may be coupled to the pair of lever units 60*a* and 60*b*.

The screw 55 is rotatably supported in the housing 55*a* and the movable unit 56 may be accommodated to be movable up and down in the housing 55*a*.

The housing 55*a* may have one or more guide bars 58 and 59 for guiding upward movement of the movable unit 56. The one or more guide bars 58 and 59 are spaced apart from the screw 55 and extend in parallel with the screw 55.

In order to prevent the movable unit 56 from inclining to any one of the left and right sides from the screw 55, the housing 51 has a plurality of guide bars 58 and 59 and the screw 55 may be positioned between the plurality of guide bars 58 and 59.

The pair of first levers 61 and 62 may include first slots 61*a* and 62*a* for passing the coupling protrusion 57 of the movable unit 56.

The length of the coupling part 57 may be the same as or larger than the sum of the thicknesses of the pair of first levers 61 and 62.

The pair of first levers 61 and 62 are disposed to cross each other, and the coupling protrusion 57 passes through the first slots 61*a* and 62*a* of the first levers 61 and 62, with the first slots 61*a* and 62*a* of the first levers 61 and 62 aligned.

For example, in FIG. 8, the coupling protrusion 57 can pass through both of the first slots 61*a* and 62*a* of the first levers 61 and 62, with the upper portion of the right first lever 61 and the upper portion of the right first lever 62 overlapping each other.

As shown in FIG. 8, when the movable unit 56 is moved to the uppermost portion of the screw 55, the elevation device 80 is moved down to the lowermost position. The position of the movable unit 56 in this case may be referred to as a first position. The position of the movable unit 56 with the elevation device 80 moved up to the uppermost position may be referred to as a second position.

In this state, when the movable unit 56 is moved down, the pair first levers 61 and 62 can be rotated by the movable unit 56.

In order that the pair first levers 61 and 62 can be rotated with the coupling protrusion 57 passing through both of the first slots 61*a* and 62*a* of the pair of first levers 61 and 62, the first slots 61*a* and 62*a* may be elongated in the longitudinal direction of the first levers 61 and 62.

Accordingly, while the movable unit 56 is moved down, the coupling protrusion 57 presses down the pair of first levers 61 and 62. Further, the position of the coupling protrusion 57 is changed in the first slots 61*a* and 62*a* of the first levers 61 and 62, whereby the pair of first levers 61 and 62 can be rotated.

The angle made by the pair of first levers 61 and 62 with the movable unit 56 positioned at the first position may be about 90 degrees with respect to the coupling protrusion 57.

While the movable unit 56 is moved down, the pair of first levers 61 and 62 is rotated in opposite directions, so the angle made by the pair of first levers 61 and 62 can be increased.

The first levers 61 and 62 may further include respectively shaft holes 61*b* and 62*b* (or rotational center hole) for passing the shaft 69*a* of the lever support 69. Alternatively, the first levers 61 and 62 each may have a shaft and the shafts may be rotatably coupled to the lever support 69 or the door liner 134.

In the present embodiment, the first levers 61 and 62 may include a first end 61*d* and a second end 61*e* positioned opposite the first end 61*d*. The first end 61*d* and the second end 61*e* are longitudinally spaced apart from each other.

At the first position of the movable unit, the first end 61*d* is positioned higher than the second end 61*e*.

The shaft holes 61*b* and 62*b* (or shafts) may be positioned closer to the second end 61*e* than the first end 61*d*. That is, the shaft holes 61*b* and 62*b* may be positioned between a point, which divide the lengths of the first levers 61 and 62 into two equal parts, and the second end 61*e*.

The first slots 61*a* and 62*a* may be positioned between the shaft holes 61*b* and 62*b* (or shafts) and the first end 61*d*. In this case, the first slots 61*a* and 62*a* may be positioned closer to the first end 61*d* than the shaft holes 61*b* and 62*b*.

The first levers 61 and 62 may further include second slots 61*c* and 62*c* positioned between the shaft holes 61*b* and 62*b* and the second end 61*e*.

Lever protrusions 63*a* and 64*a* of the second levers 63 and 64 may be inserted in the second slots 61*c* and 62*c*.

In order that the second levers 63 and 64 can be rotated when the first levers 61 and 62 are rotated with respect to the shaft 69*a*, the second slots 61*c* and 62*c* may be elongated in the longitudinal direction of the second levers 61 and 62. The second levers 63 and 64 can be rotated in the opposite direction to the first levers 61 and 62.

In the present embodiment, the lengths of the first levers 61 and 62 may be larger than the lengths of the second levers 63 and 64.

Though not limited, the lengths of the first levers 61 and 62 may be three times or more larger than the lengths of the second levers 63 and 64.

Since the lengths of the second levers 63 and 64 are smaller than the lengths of the first levers 61 and 62, the lengths of the second slots 61*c* and 62*c* may be smaller than the lengths of the first slots 61*a* and 62*a*.

Further, the second slots 61*c* and 62*c* may be positioned closer to the second end 61*e* than the shaft holes 61*b* and 62*b*.

The pair of second levers 63 and 64 may be connected to the pair of first levers 61 and 62, respectively.

The second levers 63 and 64 may include lever protrusions 63*a* and 64*a* inserted in the second slots 61*c* and 62*c*.

Further, the second levers 63 and 64 may further include connecting portions 63*b* and 64*b* for connection with the elevation device 80.

Accordingly, the second levers 63 and 64 may be substantially in a horizontal position with the elevation device 80 positioned at the lowermost position.

When the second levers 63 and 64 are rotated by rotation of the first levers 61 and 62, the angle made by the second levers 63 and 64 and the horizontal plane increases, so the elevation device 80 can be moved up.

The second levers 63 and 64 may further include rotary shafts 63*c* and 64*c* connected to the supporting assemblies 70. The connecting portions 63*b* and 64*b* may be positioned in the region between the rotary shafts 63*c* and 64*c* and the lever protrusions 63*a* and 64*a*.

The shaft 69*a* or the shaft holes 61*b* and 62*b* may be positioned higher than the rotary shafts 63*c* and 64*c*. With the elevation device 80 positioned at the lowermost position, the movable unit 56 may be positioned higher than the shaft 69*a* and the lever protrusions 63*a* and 64*a* may be positioned lower than the shaft 69*a*.

Accordingly, while the first levers 61 and 62 are rotated, the first levers 61 and 62 can lift the lever protrusions 63*a* and 64*a*.

FIG. 9 is a perspective view of the drawer unit according to an embodiment of the present invention and FIG. 10 is an exploded perspective view of FIG. 9.

Referring to FIGS. 3, 9, and 10, the drawer unit 32 may include a drawer main body 38 forming the entire shape of the drawer unit 32, the elevation device 80 disposed in the drawer main body 38 and being able to moving up and down the container and food, and several plates 391, 392, and 395 forming the internal and external appearances of the drawer unit 32.

In detail, the drawer main body 38 may be made of a plastic material by injection molding and forms the entire shape of the drawer unit 32. The drawer main body 38 has a basket shape with an open top and has a receiving space therein for food. The rear surface of the drawer main body 38 may be an inclined surface 321, thereby being able to prevent interference with the machine room 3.

The door frames 316 may be mounted on both sides of the drawer unit 32. The door frames 316 may be coupled to frame mounts 383 on both sides of the bottom surface or at the lower portions of both left and right sides of the drawer unit 32. When the door frames 316 are coupled to the drawer unit 32, the drawer unit 32 and the door unit 31 are integrally combined to be able to be drawn in and out together.

The door frame 316 and the drawer unit 32 may be coupled to each other by a coupling structure using a separate coupling member or a shape-fitting structure between the door frame 316 and the drawer unit 32.

The drawing racks 34 may be disposed on both left and right sides of the bottom surface of the drawer unit 32. The drawer unit 32 can be drawn in and out in the front-rear direction by the drawing racks 34. In detail, when the drawer unit 32 is mounted on the cabinet 10, at least a portion thereof is positioned in the storage space. The drawing racks 34 may be coupled to the pinion gears 141 disposed on the floor surface of the storage space. Accordingly, when the drawing motor 141 is driven, the pinion gears 141 are rotated, so the drawing racks 34 can be moved and the door 30 can be drawn in and out.

Obviously, the door 30 may not be automatically drawn in and out and a user can draw the door 30 in and out by pushing and pulling it, and in this case, the drawing racks 34 are omitted and drawing-in and out may be guided only by the drawing rails 33.

The rail mounts 382 where the drawing rails 33 for guiding the drawer main body 38 being drawn in and out may be formed at the lower portions of both sides of the drawer main body 38. The rail mounts 382 extend from the front end to the rear end and may have a space therein in which the drawing rails 33 can be accommodated.

The drawing rails 33, which are multi-stage stretching rails, may have an end fixed in the storage space in the cabinet 10 and the other end fixed to the rail mount 382 such that the door 30 can be more stably drawn in and out.

The several plates 391, 392, 395 made of a metal material having a plate shape such as stainless steel and forming at least a portion of the internal and external appearances of the drawer main body 38.

In detail, outer side plates 391 may be disposed on both left and right outer sides of the drawer main body 38. The outer side plates 391 are mounted on both left and right sides of the drawer main body 38, thereby forming the external appearance of the both sides, and particularly, being able to prevent exposure of components such as the door frames 316 and the drawing rails 33 mounted on both sides of the drawer main body 38.

Several reinforcing ribs 384 may be formed on both left and right outer sides of the drawer main body 38 to cross each other transversely and longitudinally. For example, the several reinforcing ribs 384 may be formed in a lattice shape.

The reinforcing ribs 384 can enable the drawer main body 38 to more firmly maintain the shape against the weight of the door increased due to the driving device 40 and the elevation device 80 by increasing the strength of the drawer main body 38 itself.

The reinforcing ribs 384 can be in contact with the outer side plates 391 mounted on both sides, thereby enabling the external appearance of the drawer unit 32 to be firmly maintained.

Inner side plates 392 may be disposed on both left and right inner sides of the drawer main body 38. The inner side plates 392 are mounted on both left and right sides of the drawer main body 38 and may form both left and right inner sides.

The inner plate 395 may include a front surface portion 395*a*, a bottom surface portion 395*b*, and a rear surface portion 395*c* that have sizes and shapes corresponding to those of the inner front surface, bottom surface, and rear surface of the drawer main body 38.

The inner plate 395 may be formed by bending a plate-shaped stainless material to be able to form the other inner sides except for the left and right sides of the drawer main body 38. Both left and right side ends of the inner plate 395 may be in contact with the inner side plates 392. Obviously, the front surface portion 395*a*, the bottom surface portion 395*b*, and the rear surface portion 395*c* that constitute the inner plate 395 may be separately formed and then coupled or bonded to each other.

By the inner side plates 392 and the inner plate 395, all of the inner sides of the drawer main body 38 can be formed and the inner sides of the drawer main body 38 can provide a metallic texture.

Accordingly, the entire receiving space in the drawer unit 32 can have a metallic texture, the food received therein can be uniformly kept cool throughout the entire area, and excellent cooling performance and storing performance can be provided to a user.

The drawer cover 37 may include a cover front surface portion 371 dividing the inside of the drawer main body 38 into the front space S1 and the rear space S2, and a cover top surface portion 372 bending from the upper end of the cover front surface portion 371 and covering the top surface of the rear space S2.

That is, when the drawer cover 37 is mounted, only the front space S1 in which the elevation device 80 is disposed may be exposed in the drawer main body 38 and the rear space S2 may be covered by the drawer cover 37.

On the other hand, the elevation device 80 may be disposed in the drawer main body 38. The elevation device 80 has a structure connected with the driving device 40 to be able to move up and down, and both left and right sides may be uniformly moved up and down.

In order to couple the elevation device 80 and the driving device 40, a drawer opening 35 is formed at the lower portion of the front surface of the drawer 32.

Meanwhile, the elevation device 80 may be configured in a scissors type such that it is folded when it moves down, and it is unfolded when it is moved up so that the container or food seated on the top surface thereof is moved up and down.

The elevation device 80 may include a support plate 81 and the support plate 81 can provide a seating surface for the container 36 or a surface on which food is seated.

Meanwhile, the height of the drawer opening 35 may be at a position lower than the upper end of the elevation device 80, that is, the top surface of the support plate 81. Accordingly, when the elevation device 80 is mounted, it is possible to prevent the drawer opening 35 to be shown inside the drawer unit 32 in any states.

In addition, the support plate 81 has a size and a shape corresponding to the front space, thereby being able to prevent dirt from permeating into the elevation device 80 disposed under the front space S1 and to preclude a safety accident by blocking approach to the elevation device 80.

FIG. 11 is a perspective view showing the state when an elevation device according to an embodiment of the present invention has be moved up.

Referring to FIG. 11, the elevation device 80 may be disposed on the floor inside the drawer unit 32 and may be detachably provided in the drawer unit 32.

The elevation device 80 may include an upper frame 82, a lower frame 83, and a scissor assembly 84 disposed between the upper frame 82 and the lower frame 83.

In detail, the upper frame 82 is formed in a rectangular frame shape corresponding to the size of the front space S1 in the drawer unit 32 and the support plate 82 may be seated on the top thereof.

The upper frame 82 is a part, which is vertically moved, of the elevation device 80, and substantially supports food or the container 36 together with the support plate 81.

The upper frame 82 may include a frame part 821 forming the entire circumference of the upper frame 82. In order to secure the rigidity of the frame part 821 and reduce the weight of the frame part 821, the frame part 821 may include one or more opening 822. The frame part 821, for example, may be made of a metal material.

A first slide guide 824 in which an end of the scissor assembly 84 is received and that guides movement of the scissor assembly 84 may be formed on the bottom surface of the frame part 821.

A scissor assembly 84 may be disposed at both left and right sides of the frame part 821.

The first slide guide 824 may define a space where the scissor assemblies 84 can move. Accordingly, a portion of the scissor assemblies 84 can be moved along the first slide guide 824.

The lower frame 83 is different only in direction from the upper frame 82 and may have a structure the same as or similar to that of the upper frame 82.

The lower frame 83 may also includes a frame part 831 and the frame part 831 may include one or more openings.

Further, a second slide guide 834 in which an end of the scissor assembly 84 is received and that guides movement of the scissor assembly 84 may be disposed on the top surface of the lower frame 83.

The second slide guide 834 may define a space where the scissor assemblies 84 can move. Accordingly, the other portion of the scissor assemblies 84 can be moved along the first slide guide 834.

The scissor assembly 84 may be disposed at each of both left and right sides, and the scissor assemblies 84 at both left and right sides are operated by power transmitted from one driving motor 51, so they can be simultaneously moved to the same height.

Accordingly, when a heavy load is supported, the load can be effectively moved up by a pair of the scissor assemblies 84 to which force is independently applied at both sides, and in this case, the scissor assemblies 84 can be moved up and down with the upper frame 82 and the support plate 81 in a horizontal state.

The scissor assemblies 84 may include a plurality of first rods 841 and 842 rotatably supported by the lower frame 83 and a plurality of second rods 844 and 845 rotatably supported by the upper frame 82.

The plurality of first rods 841 and 842 may be spaced apart in parallel from each other and connected to the lower frame 83.

The plurality of second rods 844 and 845 may be spaced apart in parallel from each other and connected to the upper frame 82.

Though not limited, the plurality of second rods 844 and 845 may be positioned in the region between the plurality of first rods 841 and 842.

The lower ends of the plurality of first rods 841 and 842 may be rotatably connected to the lower frame 83 and the upper ends may be connected by a first connection shaft 843. The first connection shaft 843 can be inserted in a space of the first slide guide 824. Accordingly, the first connection shaft 843 can be move along the first slide guide 824 in the space.

While the first connection shaft 843 is moved along the first slide guide 824, the first rods 841 and 842 can be rotated and the angles of the first rods 841 and 842 from the floor can be changed.

The upper ends of the plurality of second rods 844 and 845 can be rotatably connected to the upper frame 82. For example, the upper ends of the second rods 844 and 845 may be connected by an upper shaft (not shown) and the upper shaft (not shown) may be rotatably connected to the upper frame 82.

The lower ends of the second rods 844 and 845 may be connected by a lower shaft 846. The lower shaft 846 connecting the lower ends of the second rods 844 and 845 may be positioned in a space of the second sliding guide 834. For example, the second sliding guide 834 may be positioned between the plurality of second rods 844 and 845.

The first rods 841 and 842 may be connected to the second rods 844 and 845, respectively, by a second connection shaft 847.

The first road 844 positioned close to the driving device 40 of the plurality of first rods 841 and 842 may be coupled to the second levers 63 and 64.

The first road 844 may include a lever coupling portion 841*a* protruding toward the second levers 63 and 64. The lever coupling portion 841*a* may be coupled to the connecting portions 63*b* and 64*b* to be close to the connecting portions 63*b* and 64*b* of the second levers 63 and 64.

The cross-section of the lever coupling portion 841*a* may be formed in a non-circular shape so that torque of the second levers 63 and 64 can be stably transmitted to the first rod 844.

The first rod 844 can be rotated at the same angle as the second levers 63 and 64, and as the rotational angle of the first rod 844 increases, the upper frame 82 can be moved up.

Hereafter, the state when the door 30*b* of the refrigerator 1 having the above-mentioned structure according to an embodiment of the present invention is described in more detail with reference to the drawings.

FIG. 12 is a perspective view showing the state when the lower drawer door is closed.

Referring to FIG. 12, when food is kept in the refrigerator 1, both of the rotation door 20 and the door 30 are closed. In this state, a user can draw out the door 30 and put food inside.

A plurality of doors 30 may be provided up and down and can be drawn out and opened by manipulation of a user.

The manipulation of the user may be performed by touching the manipulation part 301 disposed on the front surface of the rotation door 20 or the door 30, and opening manipulation by the manipulation device 302 disposed at the lower end of the door 30 may be possible.

The manipulation part 301 and the manipulation device 302 may be configured to respectively individually draw in and out the door 30 and move up and down the elevation device 80. Obviously, a user can also open the door 30 with the handle of the door 30 held by hand.

It is exemplified hereafter that a lower drawer door 30*b* of the doors 30 disposed up and down is opened and moved up and down, but both of the upper and lower doors 30 may be drawn in and out and moved up and down in the same manner.

FIG. 13 is a perspective view showing the state when the lower drawer door is fully open and FIG. 14 is a cross-sectional view of the drawer door in the state when the container of the drawer door is fully moved down.

Referring to FIGS. 13 and 14, when a user draws out the lower drawer door 30*b*, the lower drawer door 30*b* is drawn forward. The lower drawer door 30*b* can be drawn out while the drawing rails 33 are stretched.

Meanwhile, the lower drawer door 30*b* may be configured not in the manner in which a user opens the lower drawer door 30*b* by pulling it in person, but to be drawn out by driving of the drawing motor 14.

The drawing racks 34 disposed on the floor surface of the lower drawer door 30*b* may be coupled to the pinion gears 141 that are rotated when the drawing motor 14 disposed on the cabinet 10 is driven, and accordingly, the lower drawer door 30*b* is drawn in and out by driving of the drawing motor 14.

The lower drawer door 30*b* can be drawn out up to a distance such that at least the front space S1 in the drawer unit 32 can be fully exposed to the outside. Accordingly, in this state, when the elevation device 80 is moved up and down, the container or food is not interfered with by the doors 20 and 30 or the cabinet 10.

In this case, the drawing-in and out distance of the lower drawer door 30*b* may be determined by a drawing sensing device 15 disposed on the cabinet 10 and/or the lower drawer door 30*b*.

The drawing sensing device 15 may be configured as a sensor that senses a magnet 389 to be able to sense the state when the lower drawer door 30*b* is fully drawn out or closed.

For example, as shown in the figures, the magnet 389 may be disposed on the floor of the drawer unit 32 and the sensor may be disposed on the cabinet 10. The drawing sensing device 15 may be disposed at positions corresponding to the position of the magnet 389 when the lower drawer door 30*b* is closed and corresponding to the position of the magnet 389 when the lower drawer door 30*b* is fully drawn out. Accordingly, it is possible to determine the drawing-in and out state of the lower drawer door 30*b* using the drawing sensing device 15.

If necessary, switches may be disposed at positions where the lower drawer door 30*b* is fully drawn in and drawn out, thereby being able to sense drawing-in and out of the lower drawer door 30*b*. Further, it may be possible to sense drawing-in and out of the lower drawer door 30*b* using a sensor that counts the number of revolutions of the drawing motor 14 or measures the distance between the rear surface of the door unit 31 and the front end of the cabinet 10.

When the lower drawer door 30*b* is fully drawn out, the driving motor 51 is driven and the elevation device 80 can be operated. The elevation device 80 may be configured to operate in a situation in which the lower drawer door 30*b* is sufficiently drawn out and food or the container 36 seated on the elevation device 80 can be safely moved up and down.

That is, when the lower drawer door 30*b* is drawn out and the front space S1 is fully exposed to the outside, the elevation device 80 is operated such that the container 36 or stored food seated on the elevation device 80 is not interfered with by other doors 20 and 30 or the cabinet 10.

The state when the lower drawer door 30*b* is drawn out is described in more detail. When the lower drawer door 30*b* is drawn out to be moved up, the front space S1 has to be fully drawn out of the lower storage space 12.

In particular, the rear end L1 of the front space S1 has to be drawn out further than the cabinet 10 or the front end L2 of the upper door 20. Further, in order to prevent interference when the elevation device 80 is moved up and down, the rear end L1 has to be able to be positioned further forward than at least the cabinet 10 or the front end L2 of the upper door 20.

When the elevation device 80 is drawn out to be driven, the drawer unit 32 may be drawn out not entirely and fully, but only to a position for avoiding interference when the elevation device 80 is moved up and down, as shown in FIG. 14. In this case, at least a portion of the rear space S2 of the drawer unit 32 is positioned in the lower storage space 12. That is, the rear end L3 of the drawer unit 32 is positioned at least in the lower storage space 12.

Accordingly, even in a state when not only the weight of the lower drawer door 30*b* including the driving device 40 and the elevation device 80, but the weight of the received objects are added, it is possible to secure stable drawing-in and out and up-down movement without the drawing rails 33 or the lower drawer door 30*b* itself from sinking or being damaged.

The elevation device 80 may start to be moved up after full drawing-out of the lower drawer door 30*b* is determined. In order to secure safety of a user and prevent an injury of the stored food, the elevation device 80 may be configured to start to be operated when a set time passes after drawing-out of the lower drawer door 30*b* is determined.

Obviously, after the lower drawer door 30*b* is drawn out, a user may directly input operation of the elevation device 80 by manipulating the manipulation part 301. That is, it is possible to manipulate the manipulation part 301 in order to draw out the door 30 and it is also possible to manipulate again the manipulation part 301 in order to operate the elevation device 80.

A user may manually draw out the lower drawer door 30*b* and then manipulate the manipulation part 301 to operate the elevation device 80.

Meanwhile, until the lower drawer door 30*b* is fully drawn out, as shown in FIG. 14, the driving device 40 and the elevation device 80 are not operated and the elevation device 80 is maintained at the lowest position.

FIG. 15 is a cross-sectional view of the drawer door in the state when the container of the lower drawer door is fully moved up.

As shown in FIG. 15, when the lower drawer door 30*b* has been drawn out and an operation signal of the driving device 40 is input, the driving device 40 is operated and the elevation device 80 is moved up, whereby the state shown in FIG. 15 is obtained.

In the present embodiment, moving-up of the elevation device 80 means that the upper frame 82 is moved up by the scissor assemblies 84 and moving-down of the elevation device 80 means that the upper frame 82 is moved down by the scissor assemblies 84.

Since the driving device 40 is connected with the elevation device 80, it is a state in which power can be transmitted to the elevation device 80. Upon starting to operate the driving device 40, power is transmitted to the elevation device 80 and the elevation device 80 starts to be moved up.

Meanwhile, the elevation device 80 is continuously moved up, and is stopped when it is moved up to a position that is high enough to easily approach food or the container 36 seated on the elevation device 80, as shown in FIG. 15. In this state, a user can easily pick up the food or the container 36 even without excessively bending over.

When an elevation completion signal of the elevation device 80 is input, driving of the driving motor 51 is stopped. To this end, a height sensing device (not shown) that can sense the position of the elevation device 80 may be provided.

The height sensing device (not shown) is disposed on the door unit 31 and may be disposed at a position corresponding to the maximum height of the elevation device 80 and a position corresponding to the minimum height of the elevation device 80.

The height sensing device may be configured as a sensor that senses a magnet and can determine whether the elevation device 80 has finished being moved up by sensing the magnet disposed on the elevation device 80. The height sensing device may be configured as a switch structure such that a switch is turned on when the elevation device 80 is maximally moved up.

Alternatively, the height sensing device may sense the moved-down position of the movable unit 56. It may be possible to determine whether the elevation device 80 has been maximally moved up on the basis of a change in load that is applied to the driving motor 64.

Meanwhile, when the elevation device 80 has been maximally moved up, the driving motor 51 is stopped. In this state, the elevation device 80 is positioned in the drawer unit 32, but the food or the container 36 seated on the elevation device 80 can be positioned higher than the open top surface of the drawer unit 32, so a user can easily approach it.

In particular, since a user does not need to excessively bend over to pick up the container 36, more safe and convenient work is possible.

The state in which the elevation device 80 has been maximally moved up is described in more detail. The elevation device 80 is moved up by driving of the driving device 40 and is positioned at least lower than the upper end of the drawer unit 32.

The container 36 is seated on the driving device 80, and as for the container 36, the upper end H1 of the container 36 may be moved up higher than the upper end H2 of the lower storage space 12. The height in this case is a height that enables a user to stretch hands and pick up the container 36 without bending over, which may be a height that is the most suitable for use.

That is, the driving device 40 has a structure that is moved up in the drawer unit 32, but when the container 36 is seated on the elevation device 80, the container 36 can be positioned at a height that a user can easily approach.

After a user finishes putting food in the refrigerator, the user can move down the elevation device 80 by manipulating the manipulation part 301. Moving-down of the elevation device 80 can be achieved by backward rotation of the driving motor 51 and may be slowly performed through a reverse process of the process described above.

When the elevation device 80 finishes being moved down, the state shown in FIG. 14 is made, and completion of moving-down of the elevation device 80 may be made by the height sensing device. The height sensing device may be further provided at a corresponding position to be able to sense the magnet disposed on the elevation device 80 when the elevation device 80 is positioned at the lowermost position. Accordingly, when completion of moving-down of the elevation device 80 is sensed, the driving device 40 is stopped.

After the driving motor 51 is stopped, the lower drawer door 30*b* can be drawn in. In this case, the lower drawer door 30*b* may be closed by manipulation of the user or may be closed by driving of the drawing.

FIG. 16 is a view showing the driving device before the elevation device is fully moved up, FIG. 17 is a view showing the driving device with the elevation device fully moved up, and FIG. 18 is a view showing the relationship of rotational center and length of a first lever and a second lever.

Referring to FIGS. 8, 12, 16, and 18, when the driving motor 51 is rotated in a direction, the power of the driving motor 51 is transmitted to the screw 55 through the first gear 52 and the second gear 53.

Accordingly, the screw 55 can be rotated in a first direction. When the screw 55 is rotated in the first direction, the movable unit 56 is moved down along the screw 55.

When the movable unit 56 is moved down, the first levers 61 and 62 are rotated such that the height of the first end 61*d* of the pair of first levers 61 and 62 decreases by the coupling protrusion 57 of the movable unit 56.

In this case, the first levers 61 and 62 are rotated with respect to the shaft 69*a*, the height of the second end 62*e* of the first levers 61 and 62 increases. While the first levers 61 and 62 are rotated, the coupling protrusion 57 is moved along the first slots 61*a* and 62*a*.

When the height of the second end 62*e* of the first levers 61 and 62 increases, the heights of the lever protrusions 63*a* and 64*a* of the second levers 63 and 64 positioned in the second slots 61*c* and 62*c* increase, so the second levers 63 and 64 are rotated. That is, the second levers 63 and 64 are rotated such that the angle made by the second levers 63 and 64 and the horizontal plane increases.

While the second levers 63 and 64 are rotated, the lever protrusions 63*a* and 64*a* are moved along the second slots 61*c* and 62*c*.

As described above, when the second levers 63 and 64 are rotated at a first angle (61), the second levers 63 and 64 and the first levers 61 and 62 make a straight line. The lever protrusions 63*a* and 64*a* of the second levers 63 and 64 can come in contact with ends, which are close to the shaft 69*a*, of the second slots 61*c* and 62*c*.

In this state, the coupling protrusion 57 of the movable unit 56 is spaced apart from the ends of the first slots 61*a* and 62*a* of the first levers 61 and 62.

Accordingly, the movable unit 56 can be further moved down, and while the movable unit 56 is further moved down, the coupling protrusion 57 can be moved in the first slots 61*a* and 62*a* without interference.

Accordingly, as shown in FIG. 17, when the first levers 61 and 62 are further rotated, the rotational angle of the second levers 63 and 64 can be increased and can be rotated at a second angle (θ2).

When the second levers 63 and 64 are rotated at the second angle (θ2), the driving motor 51 can be stopped.

The first trod 841 is rotated by the rotational angle of the second levers 63 and 64, so the upper frame 82 can be moved up.

According to the present embodiment, since the lever protrusions 63*a* and 64*a* of the second levers 63 and 64 are slidably connected to the first levers 61 and 62, the first rod 841 is moved up by two handspikes, so the power of the motor 51 is increased. Accordingly, it is possible to move up the elevation device 80 even using the motor 51 having small power.

For example, referring to FIG. 18, the second levers 63 and 64 can function as first handspikes and the first levers 61 and 62 can function as second handspikes.

The distance from the rotational center C2 of the second levers 63 and 64 to the connecting portions 63*b* and 64*b* may be referred to as L1 and the distance from the rotational center C2 to the center of the lever protrusions 63*a* and 64*a* may be referred to as L2. L2 is longer than L1.

Accordingly, the power of the motor 51 can be increased by L2/L1 by the second levers 63 and 64.

Further, when the elevation device 80 has been moved down, the distance between the center of the lever protrusions 63*a* and 64*a* and a rotational center C1 (which is the center of the shaft 69*a*) may be referred to as L3, and the distance from the rotational center C1 to the outer ends of the first slots 61*a* and 62*a* may be referred to as L4. L4 is longer than L3.

The power of the motor 51 can be increased by L4/L3 by the first levers 61 and 62.

As a result, the power of the motor 51 can be increased by (L2/L1)×(L4/L3) by the first levers 61 and 62 and the second levers 63 and 64, so it is possible to move up the elevation device 80 even using the motor 51 having small power.

In general, the smaller the motor 51, the smaller the size of the motor 51. Therefore, according to the present embodiment, power is increased by the lever units even if the small-sized motor 51 is used, so it is possible to move up the elevation device 80 and the container 36 on the elevation device 80.

Accordingly, it is possible to prevent reduction of the thickness of the insulator of the door unit 31 due to downsizing of the motor 51.

Further, since two handspikes are used, there is advantage in that it is possible to maximize the elevation height of the elevation device 80 within a limited height range. That is, since it is possible to maximize the rotational angle of the second levers 64 and 64, the elevation height of the elevation device 80 can be increased.

In the present embodiment, the scissors assemblies 84 can be unfolded by an increase in rotational angle of the first rod 841.

As a result, as the scissor assembly 84 is folded, the upper frame 82 is moved up, the food or the container 36 seated on the elevation device 80 is moved up, and accordingly, the elevation device 80 is moved up to the maximum height, as shown in FIG. 15.

In this state, the driving device 40 is stopped, and when a user inputs manipulation to move down the elevation device 80 after putting food into the refrigerator, the driving motor 64 is rotated backward. The elevation device 80 is moved down by a reverse process of the process described above, and the state shown in FIG. 18 can be obtained.

Meanwhile, the present invention may be achieved in various embodiments other than the embodiment described above.

Hereafter, other embodiments of the present invention are described with reference to the drawings. In other embodiments of the present invention, the same components as those in the previous embodiment are given the same reference numerals and are not described and shown in detail.

FIG. 22 is a perspective view of a refrigerator according to another embodiment of the present invention.

Referring to FIG. 22, a refrigerator according to another embodiment of the present invention may include a cabinet 1 having a storage space partitioned up and down, and a door configured to open and close the storage space.

The door may include a rotation door 20 disposed at the upper portion of the front surface of the cabinet 10 to open and close the upper storage space and a door 30 disposed at the lower portion of the front surface of the cabinet 10 to open and close the lower storage space.

The door 30 can be drawn in and out forward and rearward, as in the previous embodiment, and may have a structure in which when the door 30 is drawn out, a container and food in the drawer unit 32 can be moved up and down by operations of the driving device 40 and the elevation device 80 in the door 30.

The elevation device 80 may be disposed in the area of a front space in the drawer unit 32, and accordingly, food can be moved up and down by the elevation device 80 in the area of the front space of the entire area of the drawer unit 32.

A manipulation part 301 or a manipulation device 302 may be disposed at a side of the door unit 31, and the driving device 40 may be disposed in the door unit 31. By manipulation of the manipulation part 301 or a manipulation device 302, the drawer door 30 can be drawn in and out and/or the elevation device 80 can be moved up and down.

The elevation device 80 is disposed at the drawer unit 32 and can be moved up and down by the driving device. The configuration of the drawer door 30 and the configuration of the driving device 40 and the elevation device 80 are the same as those in the previous embodiment, so detailed description is omitted.

A plurality of containers 361 may be disposed on the elevation device 80. The containers 361 may be sealed containers such as a Kimchi container, and several containers can be seated on the elevation device 80. The containers 361 may be moved up and down together when the elevation device 80 is moved up and down.

Accordingly, at least a portion of the container 361 may protrude upward from the drawer unit 32 when it is moved up, and a user easily picks up the container 361.

Meanwhile, even though the drawer door 32 is drawn out, the elevation device 80 may interfere with the rotation door 20 with the rotation door 20 open, so the elevation device 80 is configured to be able to move up with the rotation door 20 closed. To this end, a door switch for sensing opening and closing of the rotation door 20 may be further provided.

FIG. 23 is a perspective view of a refrigerator according to another embodiment of the present invention.

Referring to FIG. 23, a refrigerator according to another embodiment of the present invention may include a cabinet 1 having a storage space, and a door configured to open and close an open front surface of the cabinet 1.

The door forms the external appearance of the front surface of the refrigerator 1 and may be configured as a drawer door 30 that is drawn forward and rearward. Several drawer doors 30 may be continuously disposed up and down. Each of the drawer doors 30 may be independently drawn in and out by manipulation of a user, and a driving device 40 and an elevation device 80 may be disposed in the drawer door 30.

The driving device 40 may be disposed at the door unit 31 and the elevation device 80 may be disposed in the drawer unit 32. When the door unit 31 and the drawer unit 32 are combined, the driving device 40 and the elevation device 80 are connected to each other, whereby power can be transmitted.

Further, the elevation device 80 may be disposed in a front space S1 of the entire storage space of the drawer unit 32.

The drawer door 30 and the elevation device 80 may be individually drawn in and out and moved up and down, respectively. Further, moving-up of the elevation device 80 after the drawer door 30 is drawn out, and drawing-in of the drawer door 30 after the elevation device 80 is moved down may be continuously performed.

When a plurality of drawer doors 30 is disposed up and down, the elevation device 80 in a drawer door 30 disposed at a relatively low position is not moved up with a drawer door 30 disposed at a relatively high position drawn out, whereby it is possible to prevent stored food and a container from interfering with the drawer door 30 drawn out at a relatively high position.

Although an example in which the elevation device 80 has been moved up with the drawer door 30 at the lowermost position drawn out, all of the drawer doors 30 disposed at higher positions can be configured such that they are drawn out and then the elevation devices 80 therein can be moved up and down.

Obviously, if the heights of the drawer doors 30 disposed at higher positions are sufficiently large, only the drawer door 30 at the lowermost position or the drawer doors 30 at relatively higher positions may have a structure that can be moved up and down.

FIG. 24 is a perspective view of a refrigerator according to another embodiment of the present invention.

As shown in the drawings, a refrigerator according to another embodiment of the present invention may include a cabinet 1 having a storage space, and a door configured to open and close an open front surface of the cabinet 1.

The storage device in the cabinet 10 may be partitioned up and down, and if necessary, the upper and lower storage device may be partitioned again to the left and right.

The door may be composed of a rotation door 20 disposed at the upper portion the cabinet 10 and rotatably mounted to open and close the upper storage space and a door 30 disposed at the lower portion of the cabinet 10 and mounted to be able to be drawn in and out to open and close the lower storage space.

The lower space of the cabinet 10 may be partitioned left and right and the drawer door 30 may be provided in pairs to be able to open and close the partitioned lower spaces, respectively. The drawer door 30 is disposed in pairs in parallel at both left and right sides, and a driving device 40 and an elevation device 80 may be disposed in the drawer door 30.

The driving device 40 may be disposed at the door unit 31 and the elevation device 80 may be disposed in the drawer unit 32. When the door unit 31 and the drawer unit 32 are combined, the driving device 40 and the elevation device 80 are connected to each other, whereby power can be transmitted. Further, the elevation device 80 may be disposed in a front space S1 of the entire storage space of the drawer unit 32.

The drawer door 30 has the same configuration as the previous embodiments and may be drawn in and out by manipulation of a user. Further, the elevation device 80 is moved up when the drawer door 30 is drawn out, so a user can more conveniently approach food or containers in the drawer door 30.

The invention claimed is:

1. A refrigerator comprising:

a cabinet having a storage space;

a door including a door unit to open or close the storage space and a drawer unit to provide a receiving space;

a driving device disposed at the door unit to provide power; and an elevation device disposed at the drawer unit, connected with the driving device, to move up or down, wherein the driving device includes:

a motor assembly including a driving motor, a screw rotated by power from the driving motor and extending in an up-down direction, and a movable unit to move up and down along the screw; and a pair of lever units connected with the movable unit at both sides of the motor assembly, respectively, and each of the pair of lever units includes:

a first lever connected with the movable unit; and a second lever connected with the first lever and connected with the elevation device, wherein when the first lever rotates in a first direction, the second lever rotates in a second direction opposite to the first direction by the first lever.

2. The refrigerator of claim 1, further comprising a supporting assembly to rotatably support the second lever.

3. The refrigerator of claim 1, wherein the movable unit includes a coupling protrusion, and the coupling protrusion is coupled to the pair of first levers.

4. The refrigerator of claim 3, wherein the coupling protrusion is coupled to the pair of first levers in a state in which the pair of first levers overlap with each other.

5. The refrigerator of claim 1, wherein a length of the first lever is longer than a length of the second lever.

6. The refrigerator of claim 3, further comprising:

a shaft, wherein the first lever rotates with respect to the shaft when the movable unit moves up and down;

the first lever includes a first end and a second end that are longitudinally spaced apart from each other, and the shaft is positioned between the first end and the second end; and the coupling protrusion is coupled to the first lever between the shaft and the first end.

7. The refrigerator of claim 6, wherein when the movable unit moves from a first position to a second position that is lower than the first position, the elevation device moves up while the movable unit moves from the first position to the second position.

8. The refrigerator of claim 7, wherein the first end of the first lever is positioned higher than the second end of the first lever when the movable unit is disposed at the first position.

9. The refrigerator of claim 6, wherein a distance between the first end of the first lever and the shaft is longer than a distance between the second end of the first lever and the shaft.

10. The refrigerator of claim 6, wherein the first lever includes a first slot in which the coupling protrusion is inserted and is elongated in a longitudinal direction of the first lever.

11. The refrigerator of claim 10, wherein the first slot is formed between the shaft and the first end of the first lever.

12. The refrigerator of claim 11, wherein the first slot is positioned closer to the first end of the first lever than the shaft.

13. The refrigerator of claim 10, wherein the second lever includes a lever protrusion to couple to the first lever; and the first lever further includes a second slot in which the lever protrusion is inserted, and the second slot is elongated in the longitudinal direction of the first lever.

14. The refrigerator of claim 13, wherein the second slot is formed between the shaft and the second end of the first lever.

15. The refrigerator of claim 13, wherein a length of the first slot of the first lever is longer than a length of the second slot of the first lever.

16. The refrigerator of claim 13, wherein the second lever further includes a rotary shaft and a connecting portion to connect to the elevation device, and the connecting portion is positioned between the rotary shaft and the lever protrusion.

17. The refrigerator of claim 13, wherein the elevation device includes:

a lower frame configured to be fixed to the drawer unit;

an upper frame configured to be movable in the up-down direction by the driving device, wherein the movable unit is positioned higher than the shaft in a state in which the upper frame is located at a lowermost position, and when the movable unit moves down, an angle made by the pair of first levers with respect to the coupling protrusion increases and an angle made by the second lever with respect to a horizontal plane increases.

18. The refrigerator of claim 17, wherein the second lever further includes a rotary shaft and a connecting portion to connect to the elevation device, and wherein the rotary shaft and the lever protrusion of the second lever are positioned lower than the shaft in a state in which the upper frame of the elevation device is located at a lowermost position.

19. A refrigerator comprising:

a cabinet having a storage space;

a door including a door unit to open or close the storage space and a drawer unit to provide a receiving space;

a driving device disposed at the door unit to provide power; and an elevation device disposed at the drawer unit, connected with the driving device, to move up or down, wherein the driving device includes:

a motor assembly including a driving motor and a movable unit to move up and down between a first position and a second position by power from the driving motor;

a first lever connected to the movable unit; and a second lever rotated by torque from the first lever, and connected with the elevation device.

20. The refrigerator of claim 19, wherein a length of the first lever is longer than a length of the second lever, and when the movable unit moves from the first position to the second position, the elevation device moves up as an angle made by the second lever with respect to a horizontal plane increases.

21. A refrigerator comprising:

a cabinet having a storage space;

a door including a door unit to open or close the storage space and a drawer unit to provide a receiving space;

a driving device disposed at the door unit to provide power; and an elevation device disposed at the drawer unit, connected with the driving device, to move up or down, wherein the driving device includes:

a motor assembly including a driving motor, a screw rotated by power from the driving motor and extending in an up-down direction, and a movable unit to move up and down along the screw; and a pair of lever units connected with the movable unit at both sides of the motor assembly, respectively, and each of the pair of lever units includes:

a first lever connected with the movable unit; and a second lever connected with the first lever and connected with the elevation device, wherein the second lever includes a lever protrusion to couple to the first lever;

a rotary shaft; and a connecting portion to connect to the elevation device, and wherein the connecting portion is positioned between the rotary shaft and the lever protrusion.

22. A refrigerator comprising:

a cabinet having a storage space;

a door including a door unit to open or close the storage space and a drawer unit to provide a receiving space;

a driving device disposed at the door unit to provide power; and an elevation device disposed at the drawer unit, connected with the driving device, to move up or down, wherein the driving device includes:

a motor assembly including a driving motor, a screw rotated by power from the driving motor and extending in an up-down direction, and a movable unit to move up and down along the screw; and a pair of lever units connected with the movable unit at both sides of the motor assembly, respectively, and each of the pair of lever units includes:

a first lever connected with the movable unit and rotatable with respect to a shaft; and a second lever connected with the first lever and connected with the elevation device, wherein the elevation device includes:

a lower frame configured to be fixed to the drawer unit;

an upper frame configured to be movable in the up-down direction by the driving device, wherein the movable unit is positioned higher than the shaft in a state in which the upper frame is located at a lowermost position, and when the movable unit moves down, an angle made by the pair of first levers with respect to the coupling protrusion increases and an angle made by the second lever with respect to a horizontal plane increases, wherein the rotary shaft and the lever protrusion of the second lever are positioned lower than the shaft in a state in which the upper frame of the elevation device is located at a lowermost position.

* * * * *